US005550570A

United States Patent [19]

Kurata et al.

[11] Patent Number: 5,550,570

[45] Date of Patent: Aug. 27, 1996

[54] INK JET CARTRIDGE MOUNTING DEVICE AND METHOD

[75] Inventors: Mitsuru Kurata, Kawasaki; Shinji Kanemitsu; Akihiro Nomura, both of Yokohama; Tokihide Ebata; Akio Takeda, both of Kawasaki; Yasuo Miyauchi, Yokohama; Haruo Uchida, Yokohama; Shigeyoshi Onoda, Yokohama, all of Japan

[73] Assignee: Canon Kabushiki Kaisha, Tokyo, Japan

[21] Appl. No.: 295,486

[22] Filed: Aug. 25, 1994

Related U.S. Application Data

[60] Continuation of Ser. No. 888,534, May 26, 1992, abandoned, which is a division of Ser. No. 466,470, Jan. 16, 1990, Pat. No. 5,138,342.

[30] Foreign Application Priority Data

| | | | |
|---|---|---|---|
| Jan. 17, 1989 | [JP] | Japan | 1-008072 |
| Jan. 18, 1989 | [JP] | Japan | 1-009183 |
| Jan. 27, 1989 | [JP] | Japan | 1-018006 |
| Apr. 25, 1989 | [JP] | Japan | 1-105487 |
| Dec. 20, 1989 | [JP] | Japan | 1-330034 |

[51] Int. Cl.[6] ..... B41J 2/175

[52] U.S. Cl. ..... 347/49

[58] Field of Search ..... 346/139 R, 139 C; 347/49, 50; 400/175

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,350,448 | 9/1982 | Hanagata et al. | 400/175 X |
| 4,459,600 | 7/1984 | Sato et al. | 346/140 R |
| 4,463,359 | 7/1984 | Ayata et al. | 346/140 R |
| 4,530,611 | 7/1985 | Borcenk et al. | 400/175 |
| 4,558,333 | 12/1985 | Sugitani et al. | 346/140 R |
| 4,628,332 | 12/1986 | Matsuda | 346/140 R |
| 4,633,274 | 12/1986 | Matsumoto | 346/140 R |
| 4,635,080 | 1/1987 | Watanabe | 346/140 R |
| 4,692,778 | 9/1987 | Yoshimura et al. | 346/140 R |
| 4,709,246 | 11/1987 | Piatt et al. | 346/140 R |
| 4,709,247 | 11/1987 | Piatt et al. | 346/140 R |
| 4,723,129 | 2/1988 | Endo et al. | 346/1.1 |
| 4,734,717 | 3/1988 | Rayfield | 346/140 R |
| 4,736,213 | 4/1988 | Piatt et al. | 346/140 R |
| 4,740,796 | 4/1988 | Endo et al. | 346/1.1 |
| 4,755,836 | 7/1988 | Ta et al. | 346/140 R |
| 4,907,018 | 3/1990 | Pinkerpell et al. | 346/140 R |
| 5,138,342 | 8/1992 | Kurata et al. | 346/140 R |
| 5,175,565 | 12/1992 | Ishinga et al. | 346/140 R |
| 5,245,361 | 9/1993 | Kashimura et al. | 347/50 |

FOREIGN PATENT DOCUMENTS

| | | | |
|---|---|---|---|
| 3511699 | 10/1985 | Germany . | |
| 59161667 | 12/1980 | Japan . | |
| 0044659 | 4/1981 | Japan | 400/175 |
| 59-123670 | 7/1984 | Japan . | |
| 59-138461 | 8/1984 | Japan . | |

*Primary Examiner*—Benjamin R. Fuller
*Assistant Examiner*—Alrick Bobb
*Attorney, Agent, or Firm*—Fitzpatrick, Cella, Harper & Scinto

[57] ABSTRACT

An ink jet recording apparatus comprises a mounting portion on which an ink jet cartridge is detachably mounted, the cartridge having a connector and a recording head portion for discharging ink to perform image recording. The mounting portion has a body connector associated therewith for electrically connecting the connector of the cartridge to the apparatus. A recording head positioner positions the recording head portion of the cartridge on the mounting portion. An operation device displaces the cartridge and the body connector relative to each other to connect the body connector to the cartridge connector.

4 Claims, 30 Drawing Sheets

INK JET CARTRIDGE MOUNTING DEVICE AND METHOD

This application is a continuation, of application Ser. No. 07/888,534 filed May 26, 1992, now abandoned, which was a division of application Ser. No. 07/466,470 filed Jan. 16, 1990, U.S. Pat. No. 5,138,342.

BACKGROUND OF THE INVENTION

1. Field of the Invention

The present invention relates to an ink jet recording apparatus which is capable of recording images on a recording medium by discharging a recording liquid, and an ink jet cartridge which can be mounted on such an ink jet recording apparatus.

2. Description of the Related Art

In a liquid jet recording apparatus having an exchangeable liquid injecting/recording head, the recording head must be positioned precisely so as to allow the accuracy with which a recording liquid can be discharged at a required position on a recording material to be improved or so as to allow the recording head to be electrically connected to an apparatus body.

Conventional methods of, or devices for, positioning a recording head have been proposed in the specification of, for example, U.S. Pat. No. 4,692,778. In this method, a platen for retaining a recording material is provided with a recording head positioning portion. The recording head is supported at at least three points while being fixed by an elastic member.

U.S. Pat. No. 4,628,332 proposes a structure in which an elastic member is provided on the inner side of a mounting member for detachably retaining a recording head, by means of which the recording head is fixed to the mounting member. This elastic member has a convex portion for pressing the upper portion of the mounted recording head to fix the recording head firmly.

Various structures for positioning a recording head relative to a carriage for retaining the recording head have also been developed. FIG. 1 shows one example of such a recording head positioning means. In this structure, exposed surfaces of supporting plates constituting the recording heads are brought into contact with contacting surfaces of a carriage so as to allow individual recording heads to be disposed on the carriage at a predetermined interval. The side surfaces of the supporting plates of the individual recording heads are pressed by spring members 1111*a*, 1111*b*, 1111*c* and 1111*d* such that the supporting plates are reliably in contact with the contacting surfaces of the carriage 1110. The carriage 1110 is moved along a scanning rail or sliding rail 1112.

U.S. Pat. No. 4,633,274 discloses a recording head positioning structure in which electrode pins provided on the recording head and serving as positioning pins are inserted into connector sockets of the supporting member for supporting the recording head, by means of which an electrical connection with and positioning of the recording head relative to the supporting member are achieved.

Structures for achieving both positioning of a recording head relative to a recording head retaining carriage and an electrical connection between the recording head and an apparatus body have also been developed. FIG. 2 shows an example of such a structure. In this structure, a recording head 1201 and a separately formed connector 1261 are connected with each other by a flexible cable 1260. In consequence, an operation for connecting the connector 1261 provided on the distal end of the flexible cable 1260 to a connector 1262 provided on an apparatus body is required, in addition to an operation for positioning the recording head 1201. A carriage 1202 is moved along a scanning rail 1211 and a sliding rail 1212. The recording head has an ink tank 1213. A reference numeral 1263 denotes a printed circuit board.

Thus, various types of recording head positioning structures have been proposed heretofore. However, in the aforementioned structure, for example, in which a recording head and a connector are formed separately, when the recording head is to be mounted on or removed from the carriage, two operations are required: an operation of mounting the recording head on or removing it from the apparatus body, and an operation of connecting the connector provided on the head to or disconnecting it from the connector provided on the apparatus body. This is very inconvenient for users. In particular, mounting a plurality of recording heads may cause connector connection errors.

Furthermore, in a recording apparatus in which a plurality of recording heads are disposed on a carriage at a predetermined interval for recording, as in the case of the apparatus shown in FIG. 1, in a case where a full color image is recorded by moving the carriage 1110 at a fixed speed, the individual recording heads must be positioned with a high degree of accuracy so as to form an excellent image.

More specifically, the droplets having different colors and discharged from the corresponding recording heads CA, CB, CC, and CD in accordance with recording signals must be deposited on the recording material at the appropriate positions with great precision.

This is necessary, because, if the points on the recording material on which the droplets of different colors impinge shift from their predetermined positions by a certain distance (e.g., about 0.03 mm) or above, visually recognizable color defects may occur in the image formed, causing so-called printing failure and making the recording apparatus an inappropriate one which cannot fulfill the requirements of the recording apparatus.

SUMMARY OF THE INVENTION

In view of the aforementioned problems of the conventional techniques, an object of the present invention is to provide a simple and reliable structure for positioning a recording head relative to a carriage with a higher degree of accuracy.

The structure provided by the present invention is particularly suitable for use in a recording apparatus which employs a plurality of recording heads for recording images.

In other words, an object of the present invention is to provide a structure for positioning a plurality of recording heads relative to a carriage with a high degree of accuracy so as to allow an ink discharged from the plurality of recording heads to be attached to predetermined positions with a high degree of accuracy.

According to one aspect of the present invention, there is provided an ink jet recording apparatus which comprises a mounting portion on which an ink jet cartridge is detachably mounted, the cartridge having a connector and a recording head portion for discharging ink to perform recording of images. The mounting portion has a body connector associated therewith for electrically connecting the connector of the cartridge to the apparatus. Recording head positioning means position the recording head portion on the mounting portion and operation means displace the cartridge and the body connector relative to each other so as to connect the body connector with the cartridge connector.

According to another aspect of the present invention, there is provided an ink jet recording apparatus which comprises a mounting portion on which an ink jet cartridge is detachably mounted, the cartridge having a connector and a recording head portion for discharging ink to perform image recording. The mounting portion has a body connector associated therewith for electrically connecting the connector of the cartridge to the apparatus. Recording head positioning means provided on the mounting portion or the cartridge position the recording head portion of the cartridge on the mounting portion and operation means displace the cartridge and the mounting portion relative to each other so as to connect the body connector to the cartridge connector as well as to generate a pushing force in the recording head positioning means to position the recording head portion.

According to another aspect of the present invention, there is provided an ink jet recording apparatus which comprises a mounting portion on which an ink jet cartridge is detachably mounted, the cartridge having a connector and a recording head portion for discharging ink to perform recording of images. The mounting portion has a body connector associated therewith for electrically connecting the connector of the cartridge to the apparatus. Recording head positioning means position the recording head portion of the cartridge on the mounting portion. Connector positioning means position the body connector and operation means displace the cartridge and the body connector relative to each other in order to connect the body connector to the cartridge connector. The ink jet recording apparatus is arranged such that, after the cartridge connector has been connected to the body connector by the operation means, the body connector is movable in accordance with the cartridge connector.

According to another aspect of the present invention, there is provided an ink jet cartridge which can be detachably mounted on an ink jet recording apparatus. The ink jet cartridge includes a recording head portion for discharging ink to perform recording of images, a guide portion for guiding the cartridge when it is mounted on the mounting portion of the apparatus, an engaging portion for engaging a recording head positioning means of the apparatus so as to allow the recording head positioning means to position the cartridge, and a connector for electrically connecting a body connector of the apparatus to the cartridge when the cartridge is mounted on the mounting portion of the apparatus.

According to another aspect of the present invention, there is provided an ink jet recording apparatus, which comprises a mounting portion on which a cartridge is detachably mounted, the cartridge having a recording head portion for discharging ink to perform recording of images, positioning means for pressing the cartridge against the mounting portion to position the cartridge, and means for displacing the positioning means to bring the positioning means into contact with the cartridge.

According to another aspect of the present invention, there is provided an ink jet cartridge comprising a recording head having discharge openings through which liquid droplets are discharged, wherein the discharge openings are formed in contacting surfaces of a plurality of members, and the recording head has an exposed surface in the same plane as the contacting surface, the exposed surface serving as a reference surface when the recording head is positioned relative to a carriage of a liquid jet recording apparatus.

In addition, this invention includes a method of mounting an ink jet cartridge on an ink jet apparatus by the steps of positioning the ink jet cartridge relative to a mounting portion therefor on the ink jet apparatus, supporting a body connector associated with the mounting portion on the ink jet apparatus with a supporting member, connecting the body connector with a cartridge connector on the ink jet cartridge by freeing the body connector from the supporting member while bringing the cartridge connector and body connector together to establish electrical contact, and allowing the body connector to move with the cartridge connector while maintaining electrical connection therebetween.

In the present invention, both electrical connection and disconnection and reliable positioning of the recording head and releasing of that positioning can be achieved by a single series of recording head mounting/removing operations.

Furthermore, in the present invention, each of the individual recording heads is fixed relative to the carriage using as a contacting surface (a reference surface for positioning) a surface of the recording head which is in the same plane as that on which a plurality of ink discharge openings are disposed linearly. In consequence, variations in the structures of the plurality of recording heads have less effect on the accuracy with which the discharge opening arrays of the recording heads are disposed relative to the carriage. Variations in the structures of the recording heads may be caused by variations in the thickness or of warpage of the supporting plates, the substrates, or the ceiling plates of the recording heads. As a result, the individual recording heads can be readily disposed on the carriage with a high degree of accuracy.

DETAILED DESCRIPTION OF THE PREFERRED EMBODIMENTS

Embodiments of the present invention will now be described below with reference to the accompanying drawings.

[Embodiment 1]

Figure 1:
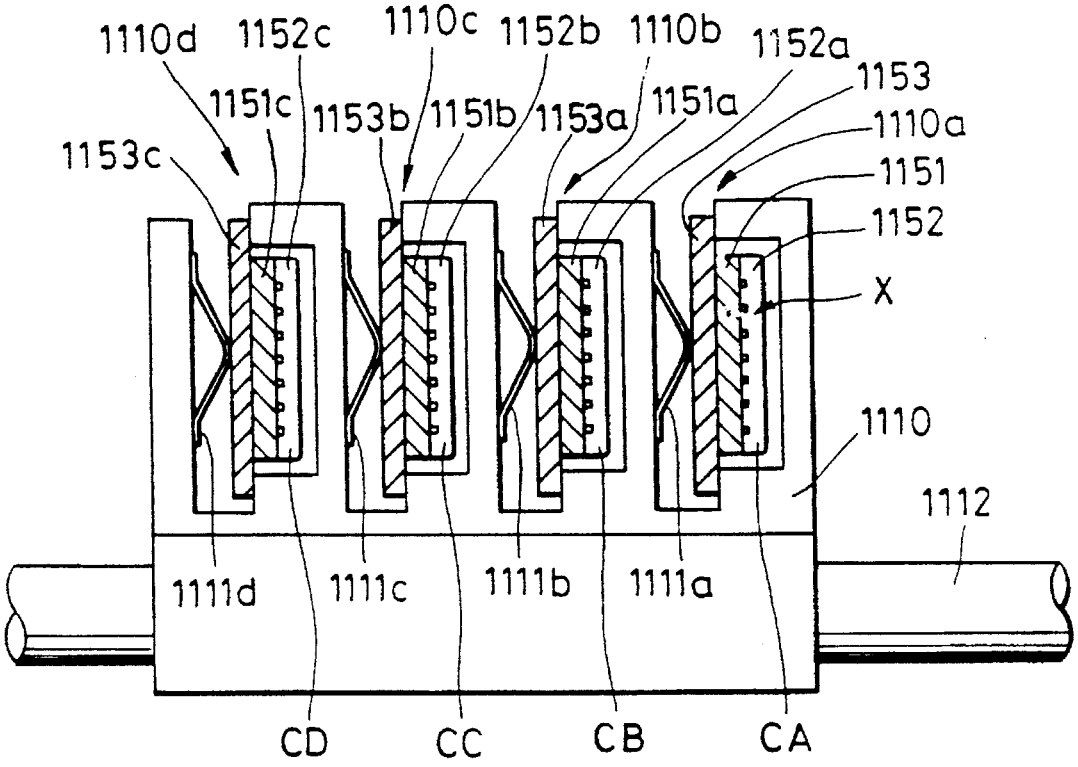
FIG. 1 PRIOR ART
FIG. 1 is a front view of the essential parts of an example of a conventional liquid jet recording apparatus.
Figure 2:
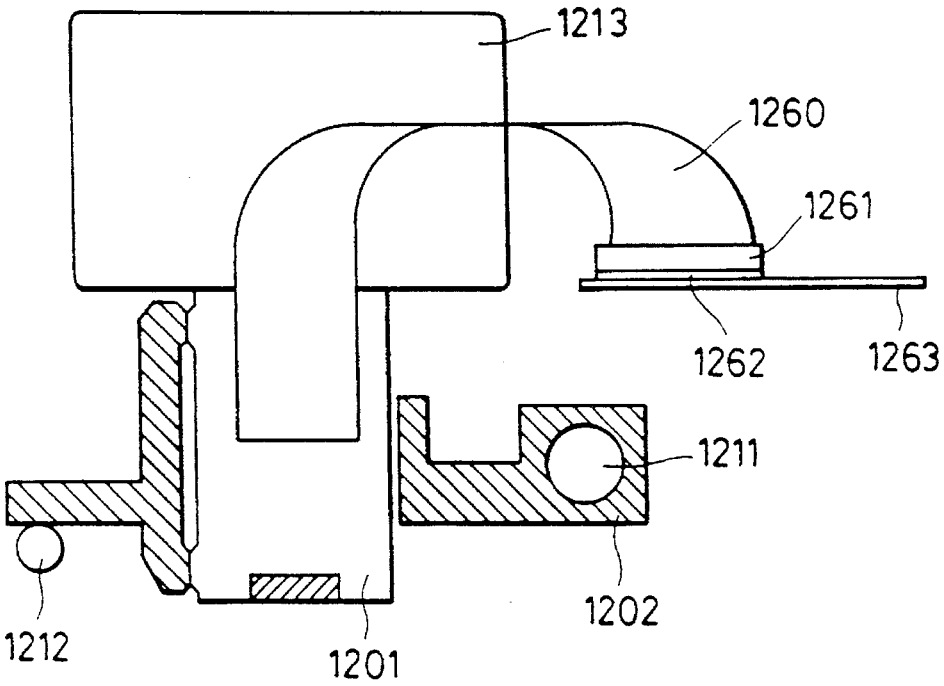
FIG. 2 PRIOR ART
FIG. 2 is a side view, partly in cross-section, of another example of a conventional liquid jet recording apparatus.
Figure 3:
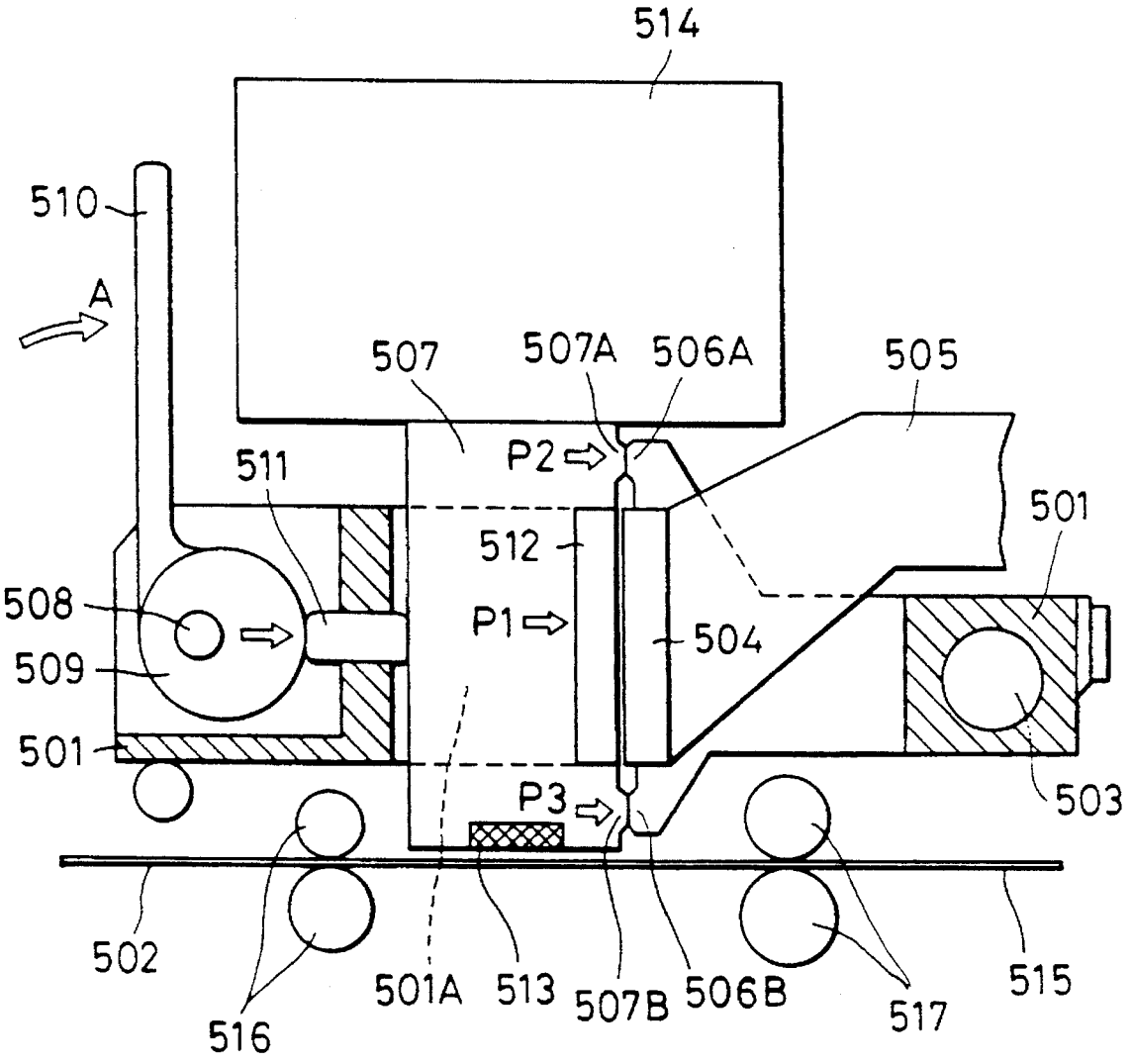
FIG. 3 is a schematic view of a recording head mounting portion of a liquid jet recording apparatus showing a first embodiment of the present invention.

FIG. 3 shows an example of a liquid jet recording apparatus to which the present invention is applied. In this recording apparatus, a recording head for discharging ink in the form of droplets and attaching the droplets to a recording material for recording images is detachably mounted on a carriage. When the recording head is mounted on the carriage, both positioning of the recording head and an electrical connection are achieved. A carriage 501 is moved in a direction perpendicular to the page along a sliding rail 502 and a scanning rail 503 by a driving means (not shown). A signal supplying connector 504 is fixed to the carriage 501, and a bundle of signal lines is connected to the connector 504. The carriage 501 has contacting surfaces 506A and 506B above and below the connector 504, respectively, with which contacting surfaces 507A and 507B of a recording head 507 make contact to position the recording head 507 when the recording head 507 is mounted on the carriage 501, as shown in FIG. 3.

The carriage 501 is provided with an eccentric cam 509 which is supported on a cam shaft 508. In consequence, when an operation lever 510 is operated in the direction indicated by the arrow, a pushing force P is generated in a pressing pin 511, the pushing force P presses a connector 512 of the recording head 507, positioned in a head mounting portion 501A of the carriage 501, against the connector 504 on the carriage 501 and brings the contact surfaces 507A and 507B of the head into contact with the contact surfaces 506A and 506B of the carriage 501.

The recording head 507 has a discharge opening array 513 through which an ink is discharged. An ink is supplied to the discharge opening array 513 from an ink tank 514. A recording sheet 515, which is a recording material, is fed while being held at a position where it faces the discharge opening array 513 by rollers 516 and 517.

In the liquid jet recording apparatus arranged in the above-described manner, when the recording head 507 is to be mounted on the carriage 501, the recording head 507, together with the ink tank 514, is first inserted into the mounting portion 501A in a state where the pressing pin 511 is retracted from the mounting portion 501A. After the contact surfaces 507A and 507B have been located at positions where they face the contact surfaces 506A and 506B, respectively, the operation lever 510 is operated so as to rotate the eccentric cam 509 and thereby press the recording head 507 against the connector 504 by means of the pressing pin 511, by means of which electrical connection between the connectors 512 and 504 and positioning of the recording head 507 are achieved.

During recording, while the carriage 501 with the recording head 507 mounted thereon is being moved along the rails 502 and 503 in a direction perpendicular to the page, ink is discharged from the discharge opening array 513 in synchronism with movement of the carriage 501 so as to perform printing or image recording on the recording sheet 515. After recording of one scanning line has been completed, the rollers 516 and 517 are driven so as to feed the recording sheet.

The above-described arrangement ensures highly accurate positioning of the recording head relative to the carriage.

However, in the above-described example, the pushing force P applied to the recording head 507 when it is mounted on the mounting portion 501A of the carriage 501 is dispersed into three portions: a pressure P1 which connects the connectors with each other, and pressures P2 and P3 which bring the contact surfaces 507A and 507B into contact with the contact surfaces 506A and 506B, respectively. At that time, these pressures P1, P2 and P3 may not be obtained adequately, e.g., pressures P2 and P3 may be sufficient whereas pressure P1 applied to the electrical connecting portions may be too little. Reversely, pressure P1 may be sufficient whereas pressures P2 and P3 may be too little. Furthermore, pressures P1, P2 and P3 may be increased at the same time by increasing the force P. However, this requires a stronger structure and a larger amount of force to mount the recording head on and to remove it from the carriage, and thus reduces operability of the apparatus.

The following embodiment is devised in order to eliminate these disadvantages.

[Embodiment 2]

Figure 4:
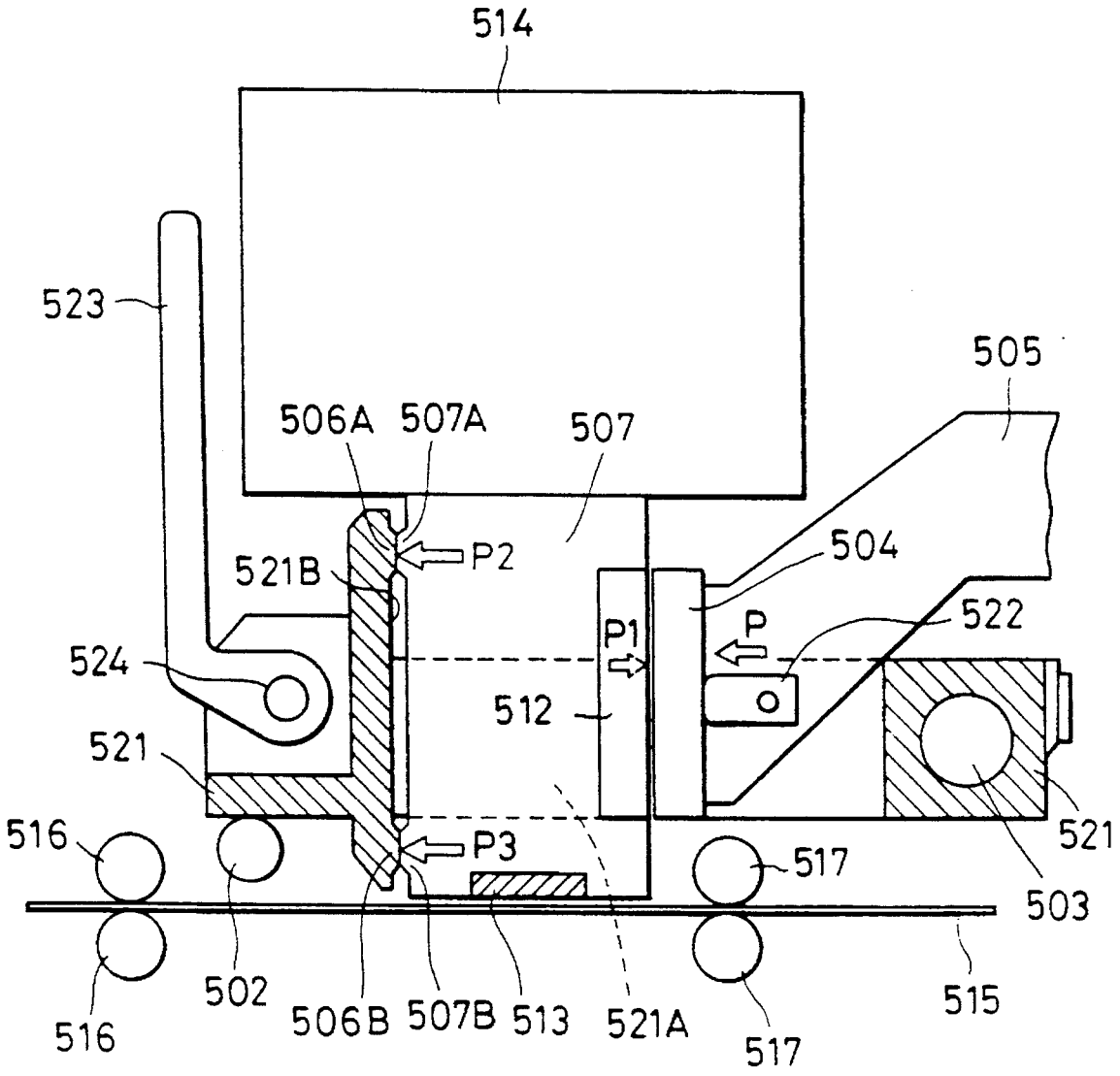
FIG. 4 is a schematic view of a recording head mounting portion showing a second embodiment of the present invention.

Referring first to FIG. 4, a carriage 521 has its contact surfaces 506A and 506B on a wall 521B of a head mounting portion 521A which is remote from the connector 504. A pressing pin 522 is provided on the back of the connector 504. The connector 504 and the pressing pin 522 are held by a guide means (not shown) in such a manner as to be movable parallel to the page, i.e., in the rightward and leftward directions. The recording head 507 has its contact surfaces 507A and 507B at positions where they face the contact surfaces 506A and 506B, respectively, and are remote from the connector 512.

Figure 5:
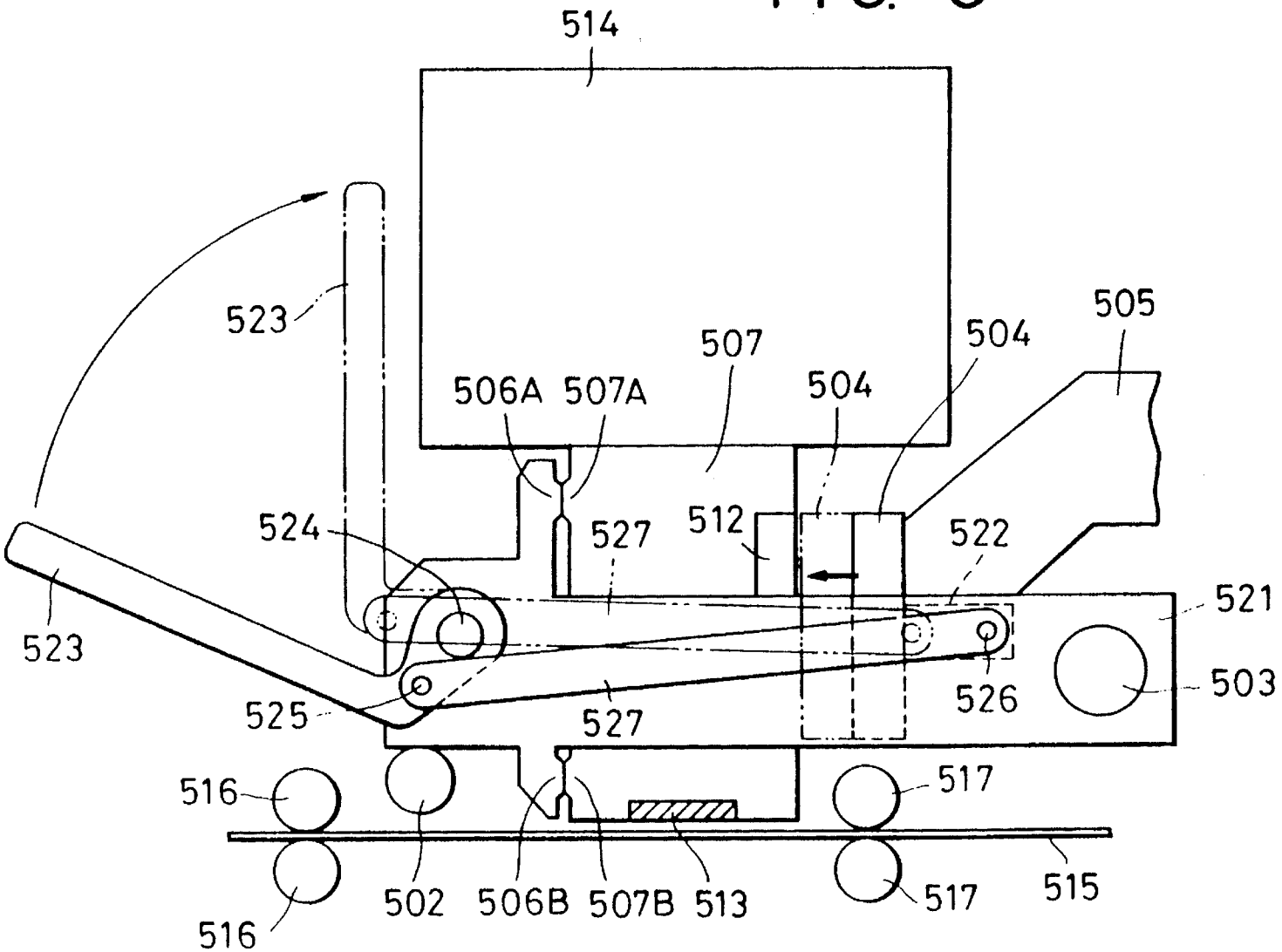
FIG. 5 is a schematic view of a pushing force generating means of the recording head mounting portion of FIG. 4.

An operation lever 523 for generating a pushing force P required for mounting the recording head 507 on the carriage 521 is provided in such a manner as to be pivotal around a lever pivot shaft 524. The operation lever 523 and the pressing pin 522 are coupled with each other by connection pins 525 and 526 and a link member 527, as shown in FIG. 5. As the operation lever 523 shown by the solid line is pivoted clockwise to the position shown by the dot-dot-dashed line, the pressing pin 522 is operated by the operation of the link mechanism, and the connector 504 is thereby moved toward the connector 512 of the recording head 507. The recording head 507 is removed from the carriage 521 by moving the operation lever 523 from the position shown by the dot-dot-dashed line to the position shown by the solid line, thereby releasing the individual components from their pressed state.

In the recording apparatus arranged as described above, as the recording head 507 is inserted into the mounting portion 521A of the carriage 521 and the connector 504 on the carriage 521 is then brought into contact with the connector 512 of the recording head 507 by the operation of the operation lever 523, pressures P1, P2 and P3 are generated on the connectors and at the positioning portions from the pushing force P which presses the connector 504 against the connector 512. The pushing force P and pressures P1, P2 and P3 have the following relation:

$$P=P1=P2+P3 \quad (1)$$

In other words, the force with which the electrical contacts are pressed against each other in the electrical connecting portion is balanced with the force with which the contact surfaces are pressed against each other in the positioning portion, and this ensures stable positioning and highly reliable electrical connection.

Figure 6:
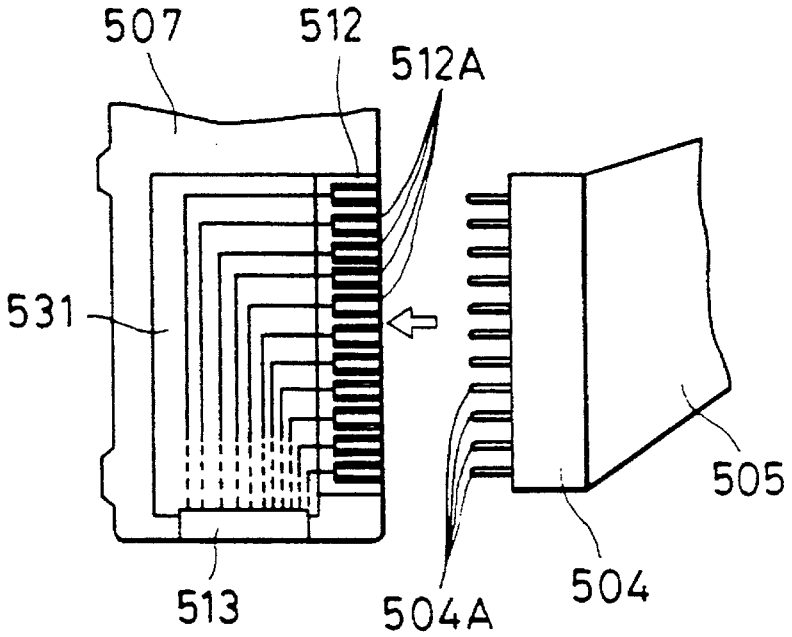
FIGS. 6 and 7 are schematic views of examples of electrical connection between the recording head and the recording apparatus according to the present invention.
Figure 7:
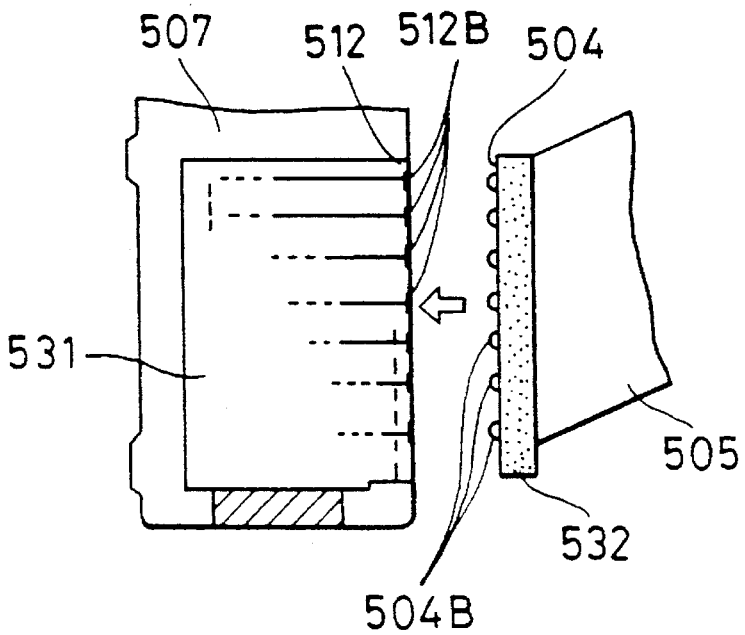

FIGS. 6 and 7 show examples of the electrical connecting portion. In the example shown in FIG. 6, the connector 512 on the recording head 507 is a female connector which consists of a plurality of female contacts 512A connected to the wiring on a printed circuit board 531, and the connector 504 on the carriage 521 is a male connector consisting of a plurality of pin-type male contacts 504A connected to the individual signal lines. The example shown in FIG. 7 is a connector for a printed wiring. The connector 512 on the recording head 507 is a pattern of a plurality of electrodes 512B connected to the printed wiring, and the connector 504 on the carriage 521 is an array of a plurality of embossed contacts 504B retained on an elastic member 532. Contact of the electrodes 512B with the contacts 504B ensures an electrical connection. In this invention, either of the configurations shown in FIGS. 6 and 7 (or any other such suitable arrangement) can be employed.

In the above-described embodiments, only one recording head is mounted on the carriage. However, the present invention can also be applied to a liquid jet recording apparatus in which recording is performed in full color using a plurality of recording heads mounted in parallel on the carriage.

In these embodiments, when the first connector is pressed against the second connector by the pressing force generating means, the pressing force of the pressing force generating means is transmitted through the recording head to the positioning portion where it is used as a pressing force. In consequence, it is not necessary for the pressing force required for positioning the recording head and the pressing force required for the electrical connection to be generated separately, and both highly reliable electrical connection and stable mounting of the recording head can be obtained at the same time.

As will be understood from the foregoing description, in the first and second embodiments to which the present invention is applied, a pressing force generating means for pressing the first connector (on the carriage) against the second connector (on the recording head) is provided on the carriage, and the pressing force of the pressing force generating means which presses the first connector against the second connector is transmitted through the recording head to the positioning portion where it is used as a pressing force. In consequence, both the pressing force required for positioning the recording head and the pressing force required for electrical connection can be generated and uniformly distributed by one pressing force generating means. As a result, the minimum pressing force can be effectively utilized, eliminating any need for an increase in the pressing force generated by the pressing force generating means. This leads to a reduction in deformation of the carriage caused by an increased pressing force and to the capability of use of a lightweight resin as the material for the associated components.

In a case where a plurality of recording heads are mounted on a carriage, as in a full-color recording apparatus, a large amount of pressing force is required to fix the recording heads. These embodiments are particularly suitable for use in such a recording apparatus.

[Embodiment 3]

In this embodiment, a connector on a body is made movable. During the insertion of the connector on the body into a connector on a recording head of a carriage, the connector on the body is fixed by a positioning means. After the insertion, fixing of the body connector is released, and the body connector is thereby made movable relative to the body so as to achieve highly accurate positioning of the recording head. Thus, in the present embodiment, both electrical connection and reliable positioning of the recording head can be achieved by a series of recording head mounting/removing operations. In this embodiment, the accuracy of recording head positioning is further improved by conducting positioning utilizing the pressure applied by a pressurizing member.

Figure 8A:
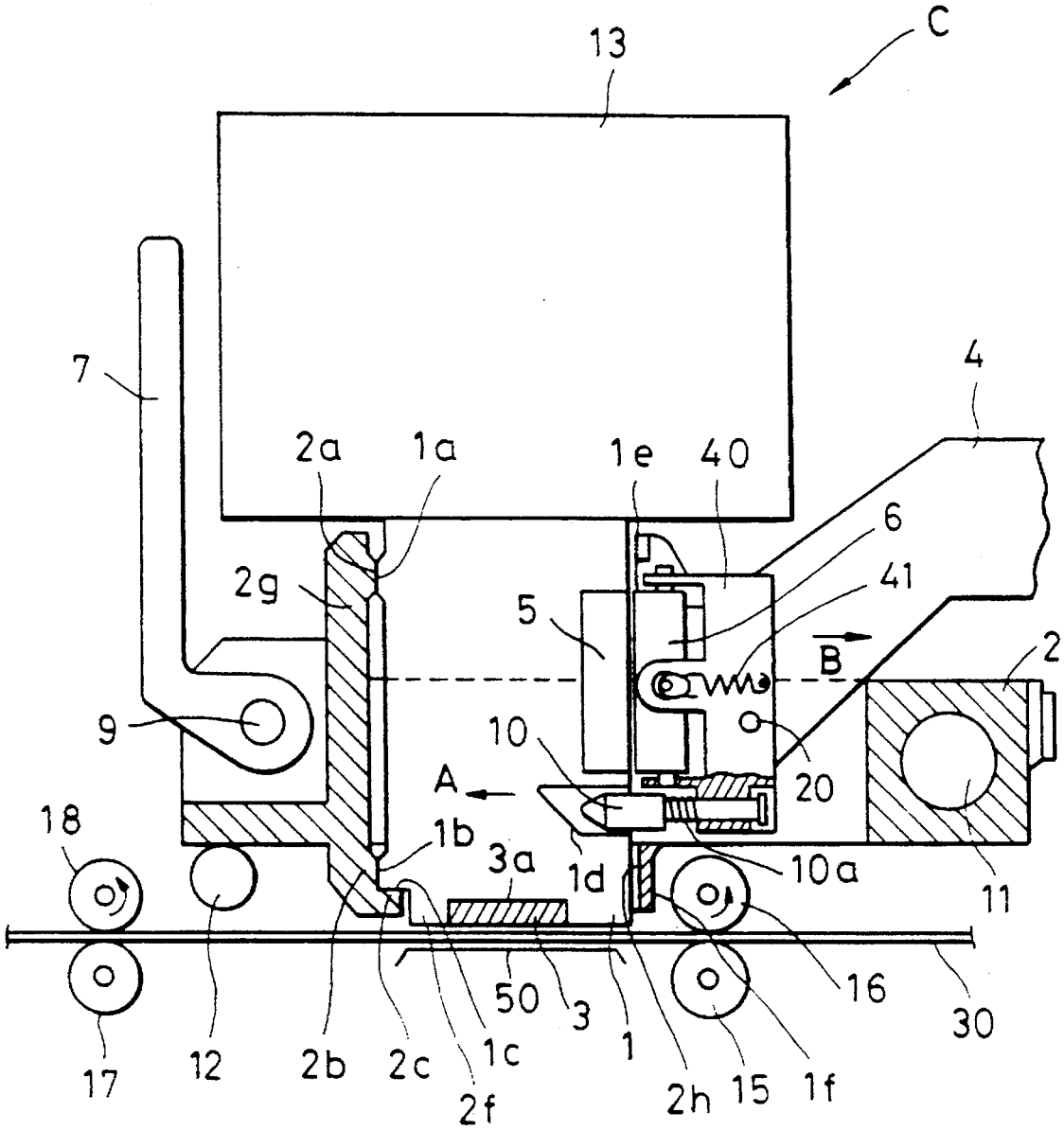
FIG. 8A is a schematic side view, partly in cross-section, of a liquid jet recording apparatus showing a third embodiment of the present invention.
Figure 8B:
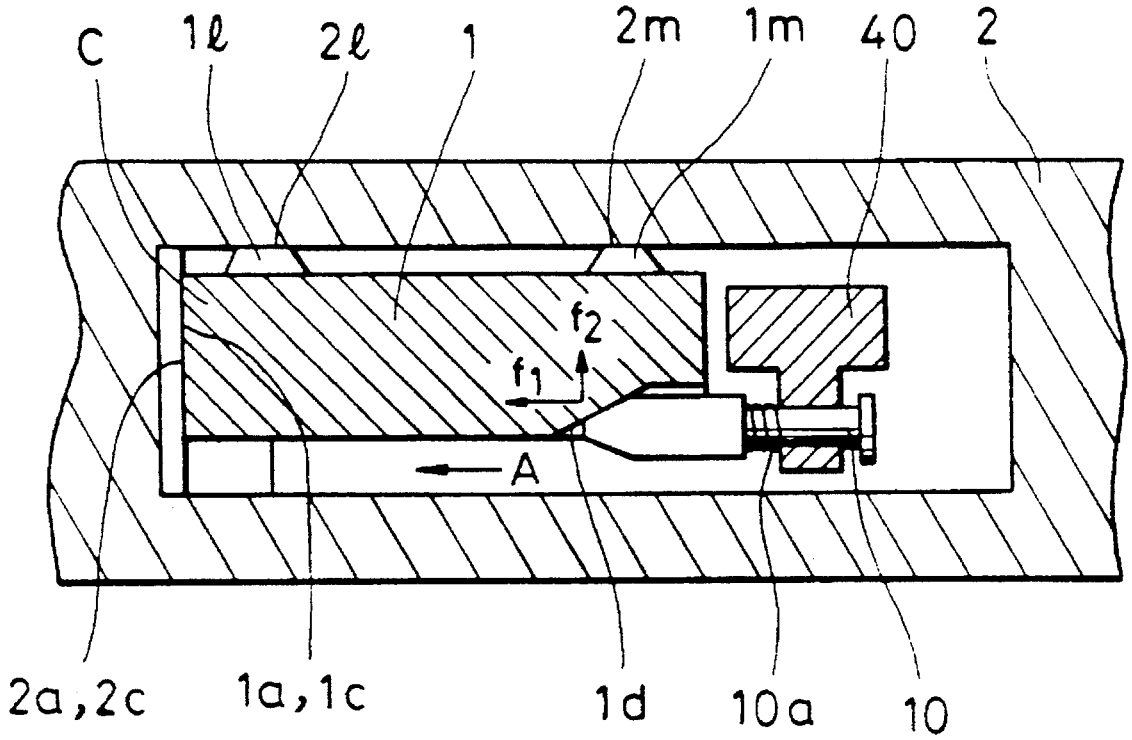
FIG. 8B is a top view of the liquid jet recording apparatus of FIG. 8A.

Referring first to FIGS. 8A and 8B, a carriage 2 on which a cartridge C with a recording head 1 (the cartridge C will be described later) can be detachably mounted is placed on a scanning rail 11 in such a manner as to be slidable therealong. One end of the carriage 2 is supported by a sliding rail 12. The carriage 2 is movable along a recording medium 30 for scanning. As the carriage 2 is moved along the recording medium 30 for scanning, ink particles supplied from an ink tank 13 are discharged from a plurality of discharge openings 3 (having an electrothermal energy conversion member 3*a* for forming droplets of ink in accordance with an image to be recorded) of the recording head 1 in accordance with an image to be recorded so as to record on the recording medium 30 images such as characters or figures. The recording medium 30 is conveyed by rollers 15, 16, 17 and 18 in synchronism with the recording of images. During the recording, the recording medium 30 is maintained at a predetermined position relative to the recording head 1 by a guide 50. The ink jet cartridge C having the recording head 1 and the ink tank 13 can be mounted on the carriage 2, as will be described in detail later (see FIGS. 15 and 16).

The cartridge C is mounted on the carriage 2 in the manner described below.

The recording head 1 of the cartridge C is arranged such that it is positioned with vertical contact surfaces 1*a* and 1*b* and a horizontal contact surface 1*c* thereof being in contact with and pressed against vertical contact surfaces 2*a* and 2*b* and a horizontal contact surface 2*c* of the carriage 2. More specifically, when the cartridge C is to be mounted on a mounting portion 2*f* of the carriage 2, the cartridge C is first located just above the mounting portion 2*f*, and then moved downward so as to insert the recording head 1 between a front end portion 2*g* and a rear end portion 2*h* of the mounting portion 2*f*, as shown in FIG. 9B. Thereafter, a lever 7, which will be described later, is operated and a connector holder 40 and a pressing pin 10 engaging with the connector holder 40 are thereby moved in the direction indicated by the arrow A (movement of the pressing pin 10, a connector 6 and the connector holder 40 in a direction indicated by the arrow A will be described in detail later) so as to press the cartridge C in a direction indicated by the arrow A. This allows the contact surfaces 1*a* and 1*b* of the recording head to come into contact with the contact surfaces 2*a* and 2*b*, thereby horizontally positioning the recording head 1 relative to the carriage 2. A surface 1*d* of the recording head 1 which engages with the pressing pin 10 is an inclined surface, and this generates a component of the pushing force which presses the horizontal contact surface 1*c* of the recording head 1 against the horizontal contact surface 2*c* of the carriage 2 and thereby positions the recording head 1 in a vertical direction. The pressing pin 10 slidably provided on the connector holder 40 is urged by a coil spring 10*a*. The recording head 1 is positioned in its crosswise direction in the manner described below.

FIG. 8B shows a state where the recording head 1 is positioned in a direction of scanning (in the crosswise direction of the cartridge C) . As shown in FIG. 8B, the recording head 1 of the cartridge C has three protrusions 1*l* and 1*m* (one of them being not shown) on its side edge, which make contact with contact surfaces 2*l* and 2*m* of the carriage 2 when the recording head is positioned in the scanning direction. At that time, since the presence of the inclined surface 1*d* of the recording head 1 generates a component f2 of a pushing force f1 generated by the pressing pin 10 in a direction indicated by the arrow A in the crosswise direction of the recording head 1, in addition to the above-described component having a vertical direction, the protrusions 1*l* and 1*m* are pressed against the contact surface 2*l* and 2*m* of the carriage, by means of which the recording head 1 is positioned in its crosswise direction. More specifically, in this embodiment, as the cartridge C is pressed by the pressing pin 10, forward, crosswise and vertical components of the pressing force are generated.

The connector 6 is mounted on the connector holder 40 with a backlash (a play) therebetween by means of a tension spring 41 which urges the connector 6 in the direction indicated by the arrow B. Reference numerals 1*e* and 1*f* denote rough guides for guiding the recording head 1 when it is inserted into the carriage 2.

The cartridge C is removed from the carriage 2 in the following manner.

Figure 9A:
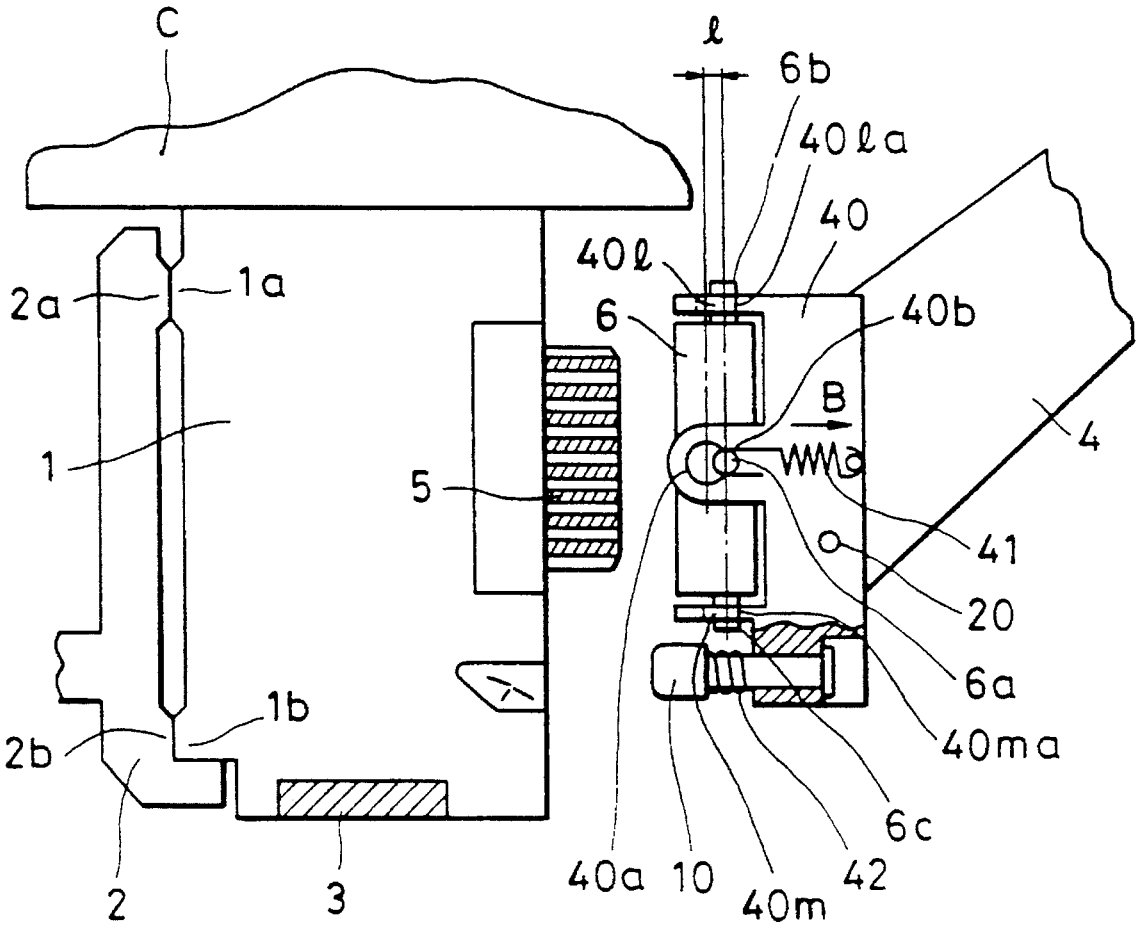
FIGS. 9A and 9B show a state where a recording head is removed from the recording apparatus of FIGS. 8A and 8B.
Figure 9B:
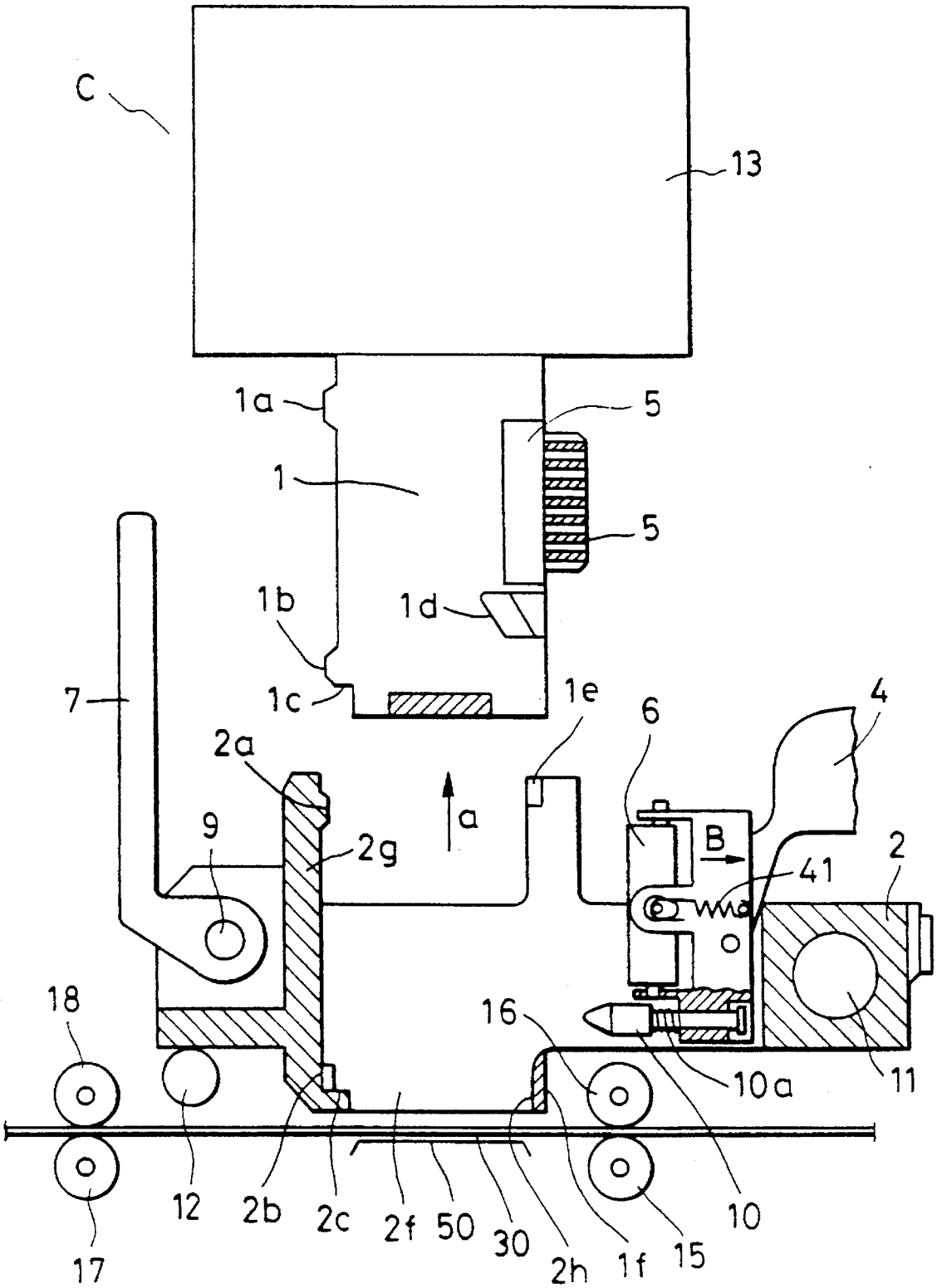

FIG. 9A shows a state where the recording head (cartridge C) is released from its positioned state, and FIG. 9B shows a state where the recording head (cartridge C) is being removed from the carriage 2.

When the cartridge C is to be removed from the carriage 2, the lever 7, which will be described later, is operated and the connector holder 40 is thereby moved in the rightward direction, as shown in FIG. 9A, so as to release the recording head 1 from its fixed state. When the connector holder 40 is moved in the rightward direction, the recording head 1 abuts against the rough guides 1*e* and 1*f* and is thereby restricted from moving further to the right. In consequence, the body connector 6 is separated from the head connector 5, and at the same time the pressing pin 10 is separated from the recording head 1 and thereby releases the recording head 1 from its positioned state (as shown in FIG. 9A). After the recording head 1 has been released from its positioned state, the connector 6 is weakly urged in the rightward direction (in the direction indicated by the arrow B) by the elastic force of the tension spring 41, and engagement shafts 6*a*, 6*b* and 6*c* of the body connector 6 are thereby fitted into engaging portions 40*b*, 40*la* and 40*ma* of engagement hole 40*a* and two engagement holes (40*l* and 40*m*) for positioning the connector 6.

FIG. 9B shows a state where the cartridge C is being removed (released) from the carriage 2.

After the separation of the head connector 5 from the body connector 6 and that of the pressing pin 10 from the recording head 1, the recording head can be raised in the direction indicated by the arrow a, as stated above.

Next, engagement and disengagement between the head connector 5 on the cartridge C and the body connector 6 will be described in detail.

Figure 10A:
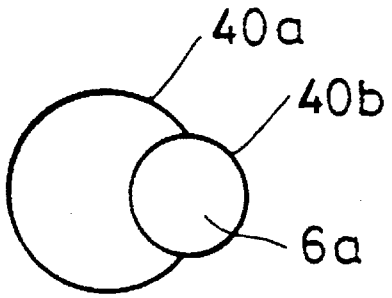
FIGS. 10A, 10B and 10C show the relation between an engagement hole and an engagement shaft in the recording apparatus of FIGS. 8A and 8B.
Figure 10B:
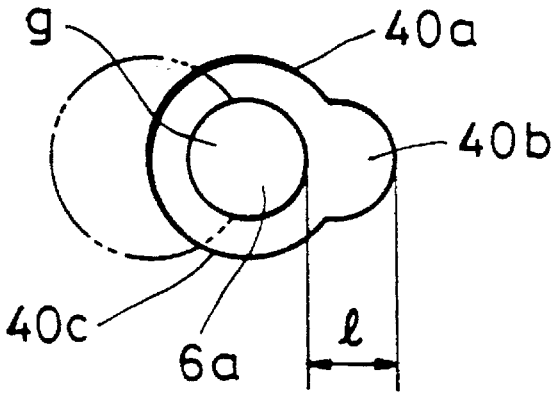
Figure 10C:
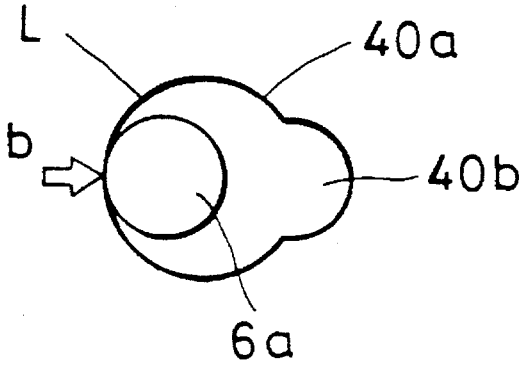

FIGS. 10A to 10C respectively show states where the engagement shaft is fitted into the engagement hole.

Turning to FIG. 10A, when the body connector 6 is to be inserted into the head connector 5, the lever 7, which will be described later, is operated in a state where the engagement shaft 6*a* integrally formed with the body connector 6 is fitted into the fitting portion 40*b* of the engagement hole in the connector holder 40 so as to move the body connector 6 and the connector holder 40 together. At that time, the head connector 5 is roughly positioned as a consequence of the insertion of the cartridge C into the mounting portion 2*f* of the carriage 2, and the body connector 6 is roughly positioned as a consequence of the fitting of the engagement shaft 6*a* into the fitting portion 40*b*. After the body connector 6 has been fitted into the head connector 5 with an inclined surface (not shown) of the body connector 6 acting as a guide surface, the connector holder 40 is moved rightwardly by a distance l, as shown in FIG. 10B (this movement of the connector holder 40 is achieved by the pivot of the lever 7, as will be described later). Movement of the connector holder 40 by this distance l allows the engagement shaft 6*a* to be separated from the fitting portion 40*b*. This results in releasing of the body connector 6 from its positioned state (it is to be noted that the body connector 6 is movable when it is in the state shown in FIG. 10A). The body connector 6 is engaged with the head connector 5 more firmly than it is urged by the tension spring 41, so it is released from the connector holder 40, i.e., the connector 6 is disengaged from the connector holder 40. At that time, since a large diameter portion 40*c* of the engagement hole 40*a* has a larger diameter than the engagement shaft 6*a* of the body connector 6, the engagement shaft 6*a* is loosely fitted into the large diameter portion 40*c* with a gap g therebetween. This means that, while the body connector 6 is in engagement with the head connector 5, the body connector 6 is disengaged from the connector holder 40. Therefore, the cartridge C (the recording head 1) is positioned relative to the carriage 2 only by the pressing force of the pressing pin 10, which ensures accurate positioning of the recording head 1 relative to the carriage 2.

FIG. 10C shows a fitting state of the engagement shaft 6*a* into the engagement hole 40*a* which is obtained when the cartridge C (the recording head 1) is removed (released). When the cartridge C is removed from the carriage 2, the lever 7, which is in its vertical position, is pivoted counterclockwise and is thereby positioned in its horizontal position so as to move the connector holder 40 rightwardly. Although the body connector 6 is engaged with the head connector 5 firmly, as the connector holder 40 moves rightwardly, a left edge L of the engagement hole 40*a* abuts against the engagement shaft 6*a*, and then pushes the engagement shaft 6*a* in the direction indicated by the arrow b (see FIG. 10C).

As a result, the body connector 6 is disengaged (released) from the head connector 5. Concurrently with this, the pressing pin 10 moves together with the connector holder 40 and is separated from the recording head 1.

Thereafter, the cartridge C can be removed from the mounting portion 2*f* in the manner shown in FIGS. 9A and 9B.

In the above description, only the relation between the engagement shaft 6*a* and the engagement hole 40*a* of the connector holder 40 has been explained. However, the same relation is established between the other engagement shafts 6*b* and 6*c* and the other corresponding two engagement holes.

Figure 11:
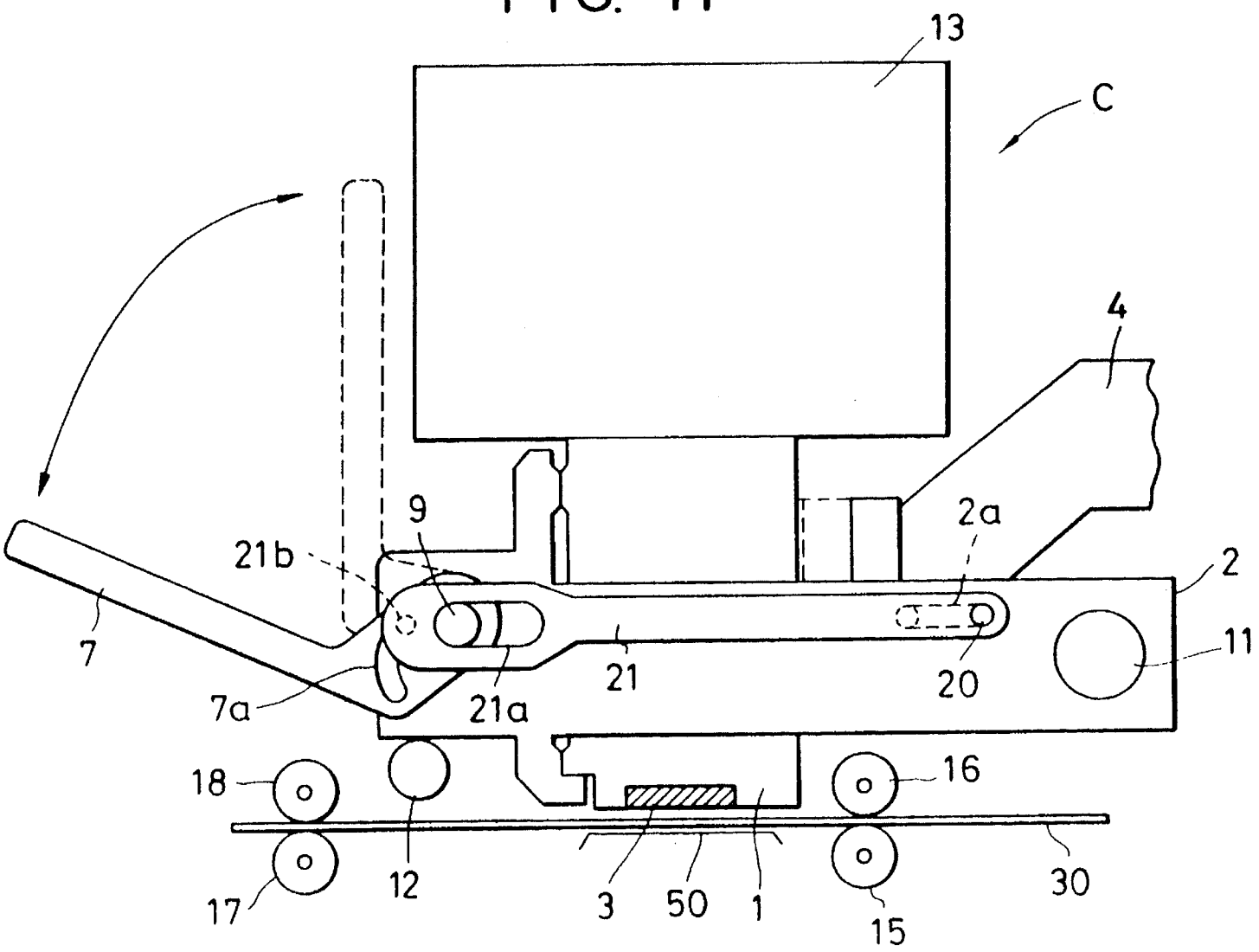
FIG. 11 is a schematic side view of an example of a link mechanism of the recording apparatus of FIGS. 8A and 8B.

FIG. 11 shows an example of a mechanism for moving the connector holder 40.

As shown in FIG. 11, a shaft 20 provided on the connector holder 40 is connected to a link 21. The shaft 20 is fitted into a slide hole 2*a* formed in the carriage 2 in such a manner as to be slidable therealong. A slide hole 21*a* formed in the link 21 receives a carriage shaft 9 in such a manner that the carriage shaft 9 can slide along the hole 21*a*. The lever 7 is rotatably engaged with the carriage shaft 9. A nib 21*b* of the link 21 is fitted into a cam hole 7*a* of the lever 7. In consequence, as the lever 7 is rotated, the link 21 is moved in the rightward and leftward directions. In FIG. 11, the position of the lever 7 shown by the solid line represents a recording-head-released state, and the lever position shown by the broken line represents a recording-head-locked state (positioned state). As the operator pivots the lever 7 from its recording-head-released state (shown by the solid line) to its recording-head-locked state (shown by the broken line), the connector holder 40 connected to the link 21 moves leftwardly first. After the body connector (not shown) has been inserted into the head connector (not shown), the link 21 moves back to the right by the distance l while being guided along the cam hole 7*a*. The cam hole 7*a* is so designed that the rotation of the lever 7 stops after the link 21 has moved back by the distance l. Also, the cam hole 7*a* is so designed that the lever 7 is pushed by the reaction of the pushing force of the pressing pin 10 which presses the recording head 1, which is transmitted to the lever 7 through the link 21, and is thereby fixed at its stop position.

More specifically, by pivoting the lever 7 clockwise, connection of the body connector 6 to the head connector 5, release of the body connector 6 from its positioned state, and the positioning of the recording head 1 can be performed in series.

The body connector 6 can be removed from the head connector 5 by pivoting the lever 6 counterclockwise.

Figure 12:
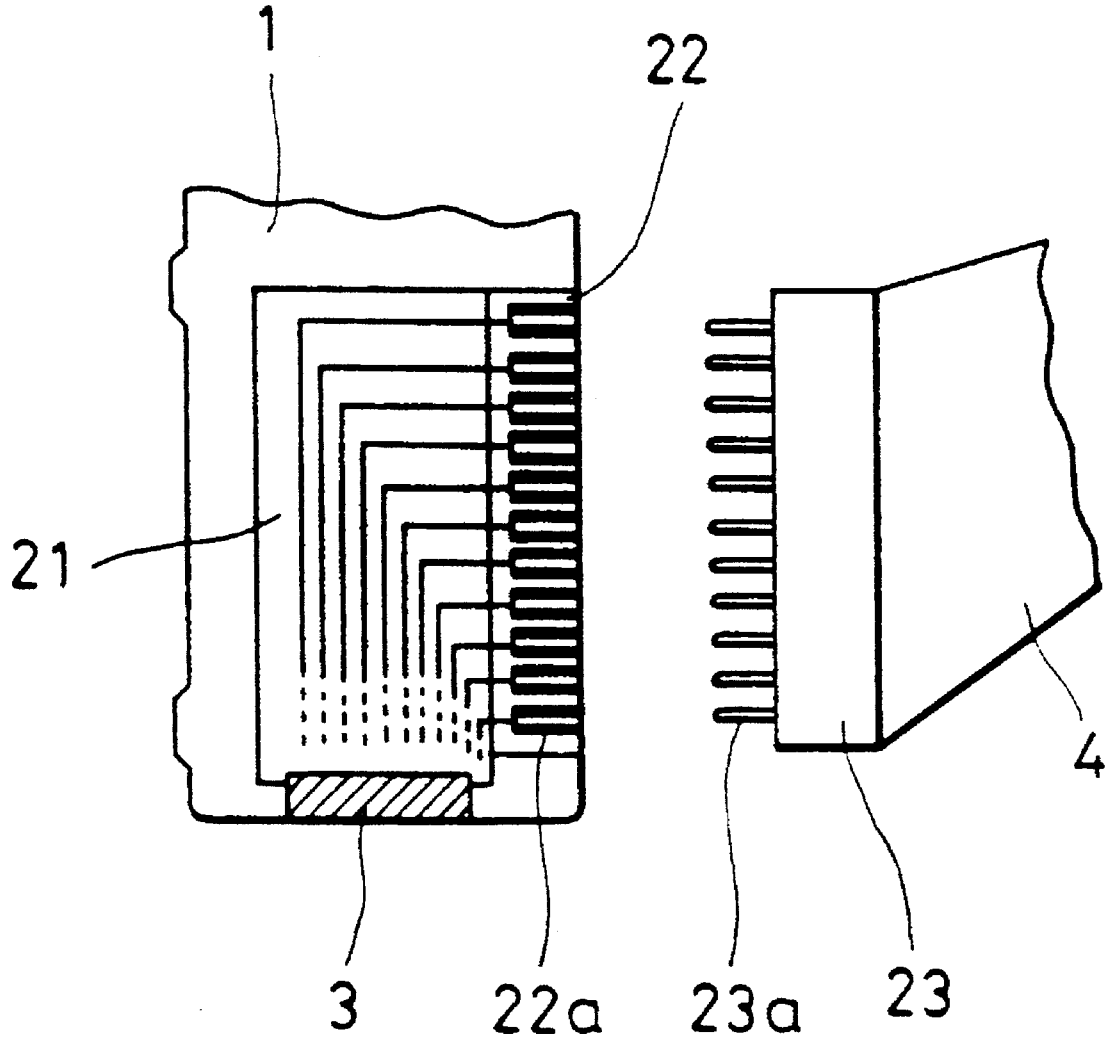
FIG. 12 is a side view of an example of a connector portion.

The above-described embodiment employs a pair of connectors consisting of the edge of a printed circuit board, and a card-edge connector. However, the present invention is not limited to this, and a pair of connectors such as those shown in FIG. 12 may also be employed. This example is a combination of male and female connectors consisting of a plurality of pins 23*a* and a plurality of recesses 22*a* which receive the pins 23*a*.

In this embodiment, only one recording head is mounted on and removed from the carriage. However, the present invention can also be applied to, for example, a full-color ink jet recording apparatus which employs a plurality of recording heads.

Figure 13:
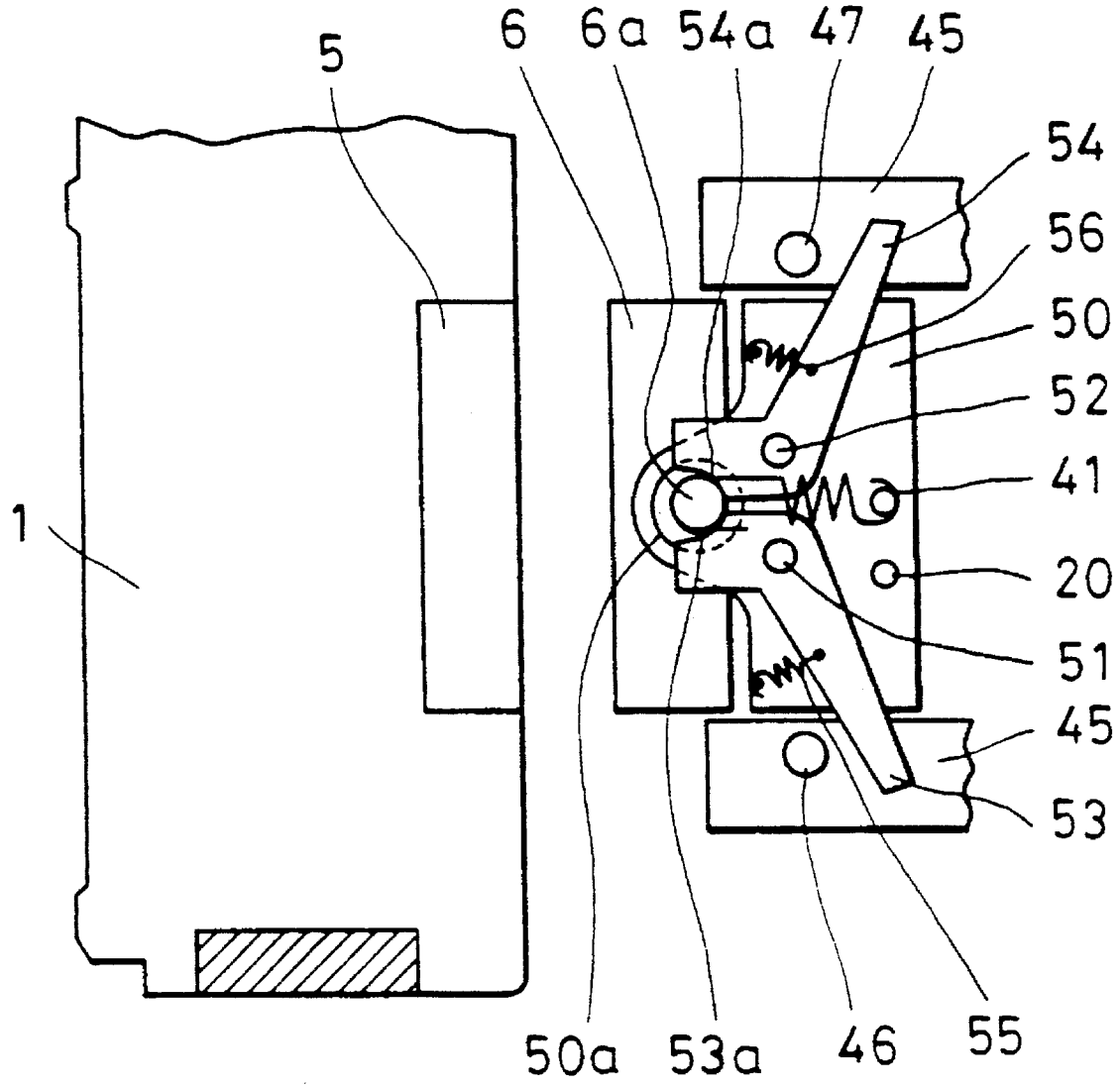
FIGS. 13 and 14 are side views of another example of an engagement hole—an engagement shaft structure.
Figure 14:
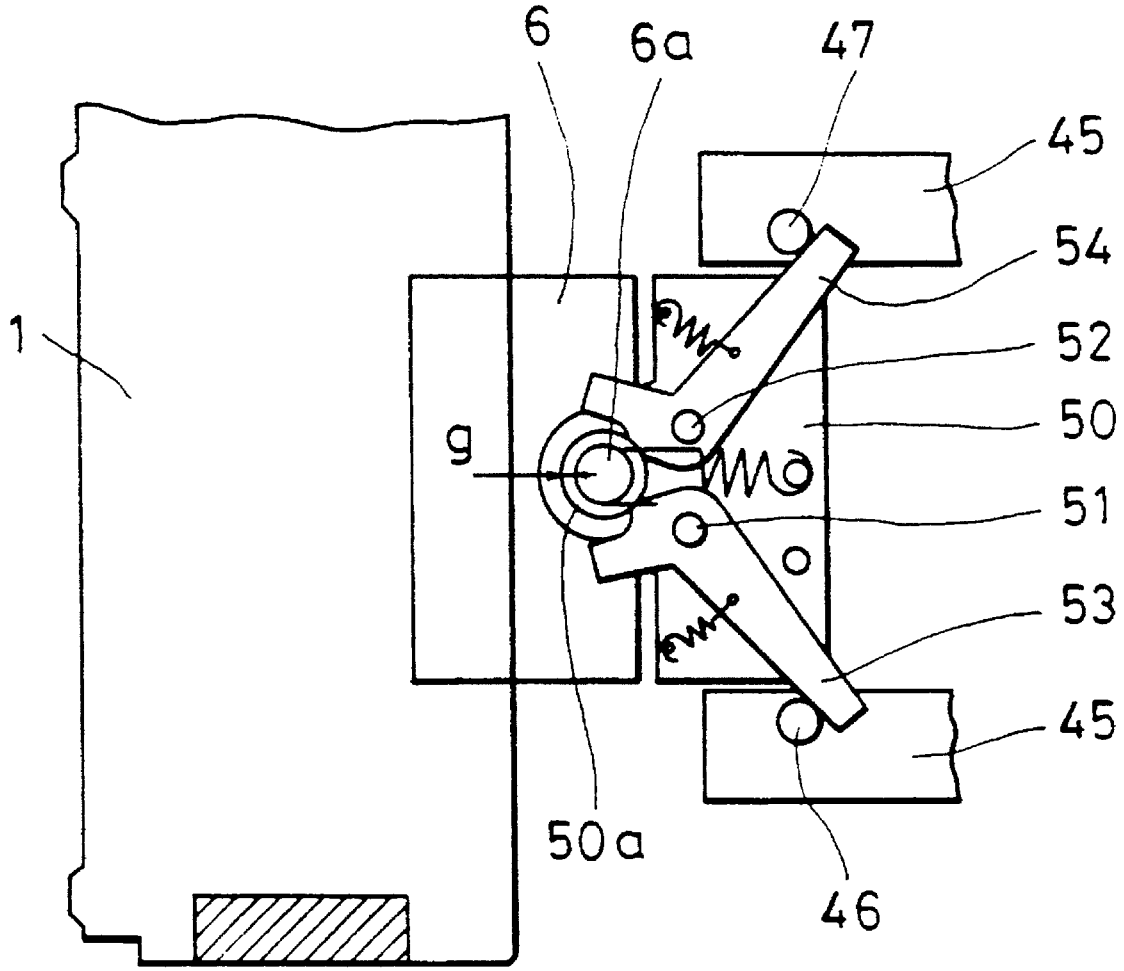

FIGS. 13 and 14 show another example of a structure for mounting a cartridge on a carriage. In FIGS. 13 and 14, arms 53 and 54 are rotatably supported on a connector holder 50 through arm shafts 51 and 52. The arm 53 is urged by a spring 55 clockwise, whereas the arm 54 is urged by a spring 56 counterclockwise. The body connector 6 is mounted on the connector holder 50 with a backlash (a play) therebetween. The body connector 6 is urged rightwardly by the tension spring 41.

When the recording head 1 is in its released state, the body connector 6 is weakly urged rightwardly by the tension spring 41. At that time, the engagement shaft 6*a* is in contact with contact portions 53*a* and 54*a* of the arms 53 and 54, by means of which the connector 6 is positioned.

FIG. 14 shows a state in which the connectors are connected with each other. When the body connector 6 is inserted into the head connector 5, the body connector 6 moves leftwardly together with the connector holder 50 in a state where the engagement shaft 6*a* of the body connector 6 is in contact with the contact portions 53*a* and 54*a* of the arms. After the body connector 6 has been engaged with the head connector 5, the arm 53 on the connector holder 50 abuts against a contact pin 46 provided on a carriage 45 and starts to rotate counterclockwise, whereas the arm 54 abuts against a contact pin 47 and begins to rotate clockwise.

This results in release of the contact of the body connector 6 with the arms 53 and 54. At that time, since the body connector 6 is connected to the head connector 5 more firmly than it is urged by the tension spring 41, it is released from the connector holder 50. Furthermore, since an engagement hole 50*a* has a larger diameter than the engagement shaft 6*a* of the body connector 6, the engagement shaft 6*a* is loosely fitted into the engagement hole 50*a* with a gap g therebetween. This means that, while the body connector 6 is in engagement with the head connector 5, the body connector 6 is disengaged from the connector holder 50.

More specifically, by pivoting the lever (not shown) and thereby moving the connector holder 50 leftwardly, connection of the body connector 6 to the head connector 5, release of the body connector 6 from its positioned state and fixing of the recording head 1 can be performed in sequence.

In the above description, only the relation between the engagement hole 50*a* of the connector holder 50 and the engagement shaft 6*a* of the body connector 6 has been described. The same relation, however, holds between the other engagement shafts and the other engagement holes.

Next, the cartridge C will be described below in detail with reference to FIG. 15 which is a perspective view of the cartridge C employed in this embodiment.

Figure 15:
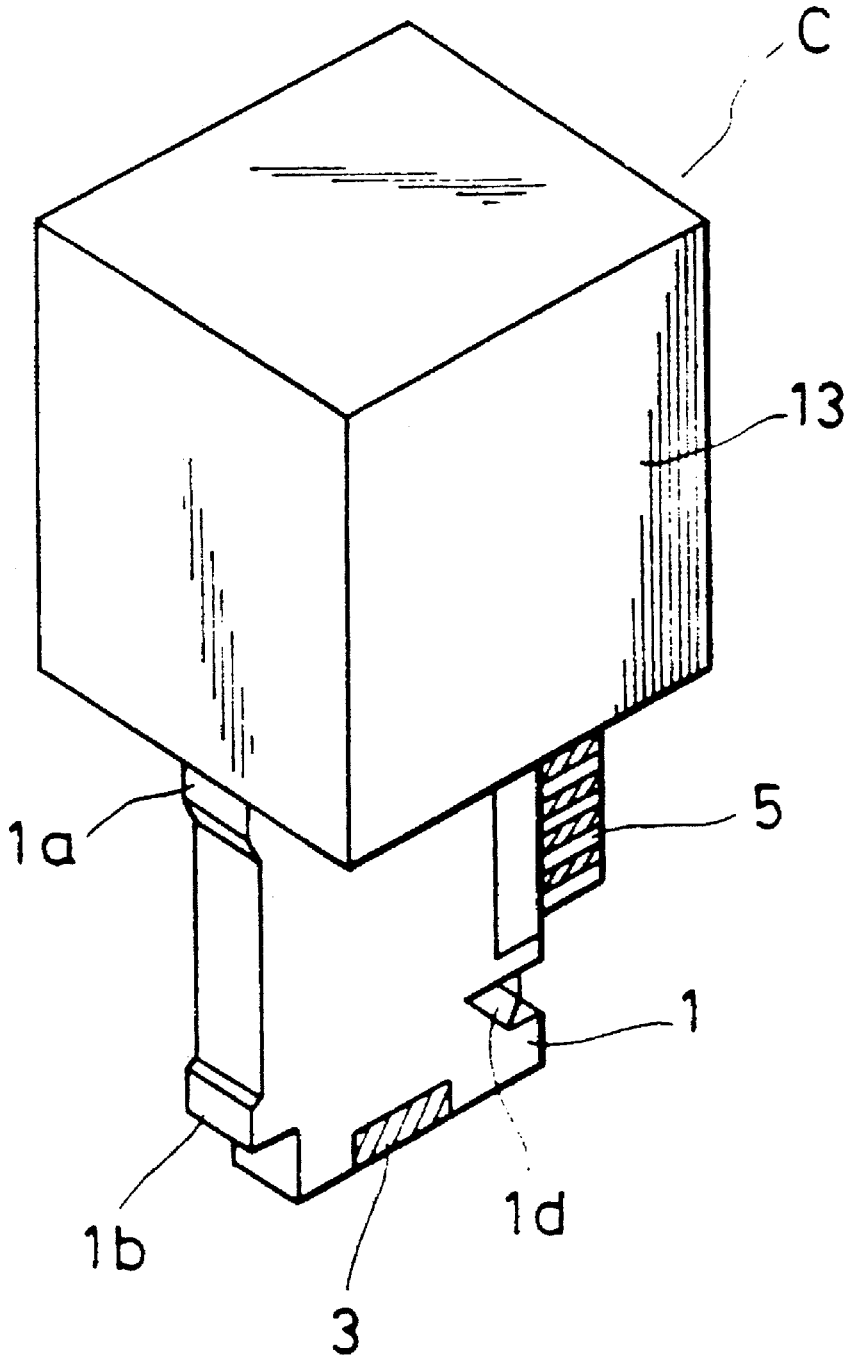
FIGS. 15 and 16 are perspective views of examples of an ink jet cartridge employed in the present invention.

As shown in FIG. 15, an upper portion of the cartridge C forms the ink tank 13, while a lower portion thereof constitutes the recording head 1. The recording head 1 has at its left edge the contact surfaces 1*a* and 1*b* and at its right edge the head connector 5. The cartridge C can be mounted on the carriage 2.

Figure 16:
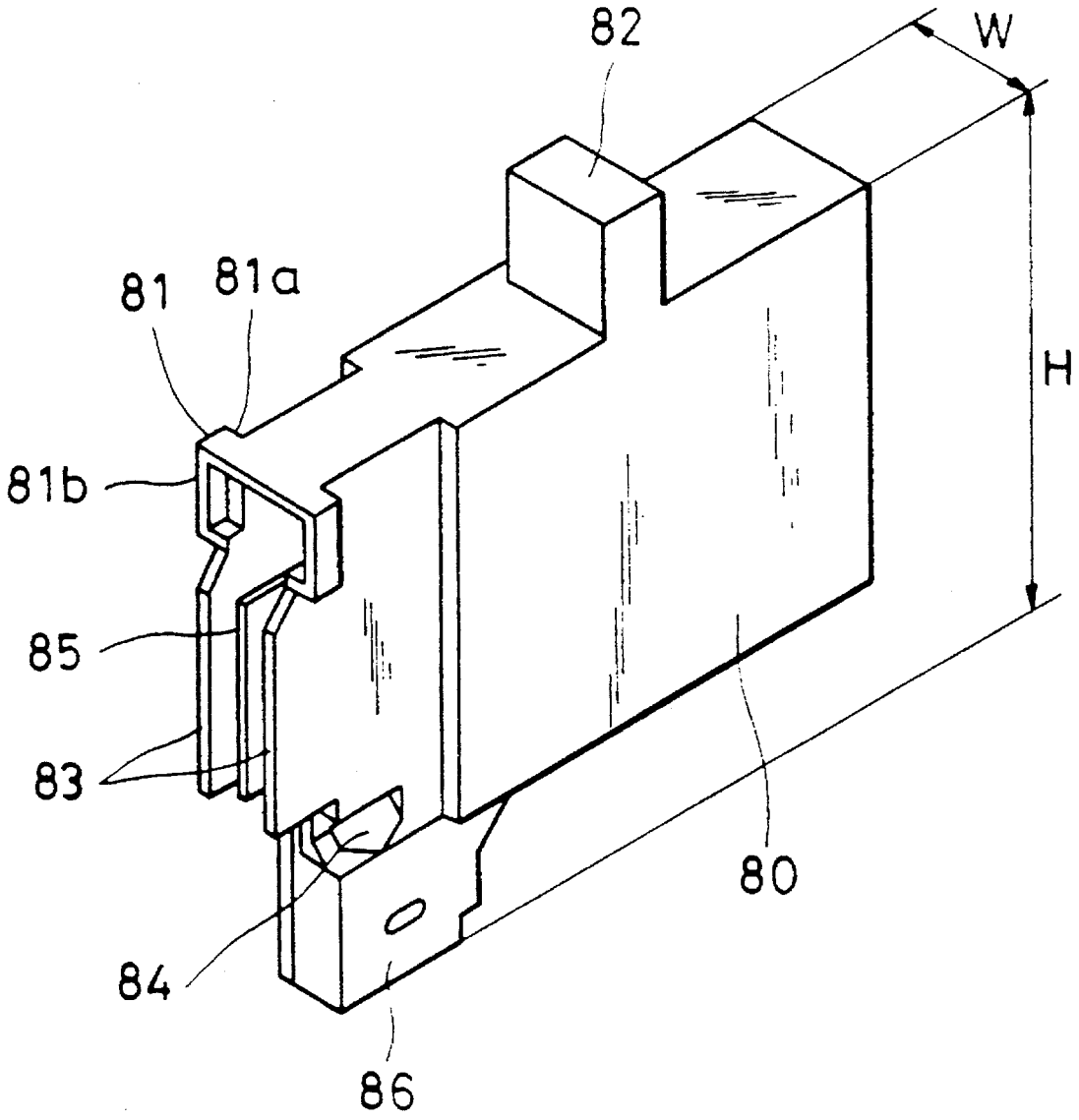

FIG. 16 is a perspective view of another example of the cartridge C.

As shown in FIG. 16, a tank portion 80 and a connector 85 are arranged side by side so as to reduce the height H of the cartridge C. Thus, the height H of the cartridge C mounted on the carriage can be maintained low.

Furthermore, since the thickness W of the cartridge is small, it is possible to reduce the size of the carriage 3, which accommodates a plurality of cartridges in an aligned state.

Connector covers 83 are formed integrally with the outer wall of the tank so as to prevent careless contact of the connector 85. A positioning portion 81 consists of contact surfaces 81*a* and 81*b*. Provision of contact surfaces (not shown) on the recording head 86 at positions separated from these positioning surfaces 81*a* and 81*b* through a sufficient distance ensures that the recording head is fixed firmly when an inclined portion 84 thereof is pressed by the pressing pin (not shown).

[Embodiment 4]

Next, a fourth embodiment of the present invention will be described below with reference to FIGS. 17A to 17D.

In this embodiment, the pressing pin which acts as a pressurizing shaft has at its distal end a tapered or rounded portion which makes contact with the recording head. The recording head has an inclined surface which makes contact with the distal end of the pressuring shaft. The carriage has a contact surface which makes contact with the outer peripheral surface of the pressuring shaft and thereby receives components having a direction perpendicular to the pressurizing shaft. Pressure is applied to the recording head by the pressurizing shaft so as to position the recording head in the mounting portion of the carriage. In this way, when the cartridge is mounted on the mounting portion, a large amount of moment is prevented from being applied to the pressing pin. This allows the pressing pin to advance smoothly from the connector holder and ensures that the recording head is positioned accurately by the elastic force of the spring of the pressing pin.

In FIGS. 17A to 17D, the same reference numerals are used to denote parts which are the same as those in the third embodiment, description thereof being omitted.

When the recording head 1 is mounted on the mounting portion 2*f*, it is positioned with its contact surfaces 1*a*, 1*b* and 1*c* in contact with and pressed against the contact surfaces 2*a*, 2*b* and 2*c* of the carriage 2. More specifically, a pressure f is applied to the recording head 1 by the pressing pin 10 engaging with the connector holder 40 which is a retaining member so as to bring the contact surfaces 1*a* and 1*b* of the recording head 1 into contact with the contact surfaces 2*a* and 2*b* of the carriage 2 and thereby position the recording head in a horizontal direction. Both the pressing pin 10 and the pressurized surface 1*d* of the recording head 1 are inclined. This generates a component f1 of the pressure f generated by the pressing pin 10, which brings the contact surface 1*c* of the recording head 1 into contact with the contact surface 2*c* of the carriage 2 and thereby positions the recording head in a vertical direction. The pressing pin 10 is urged by a coil spring 10*a*.

Figure 17A:
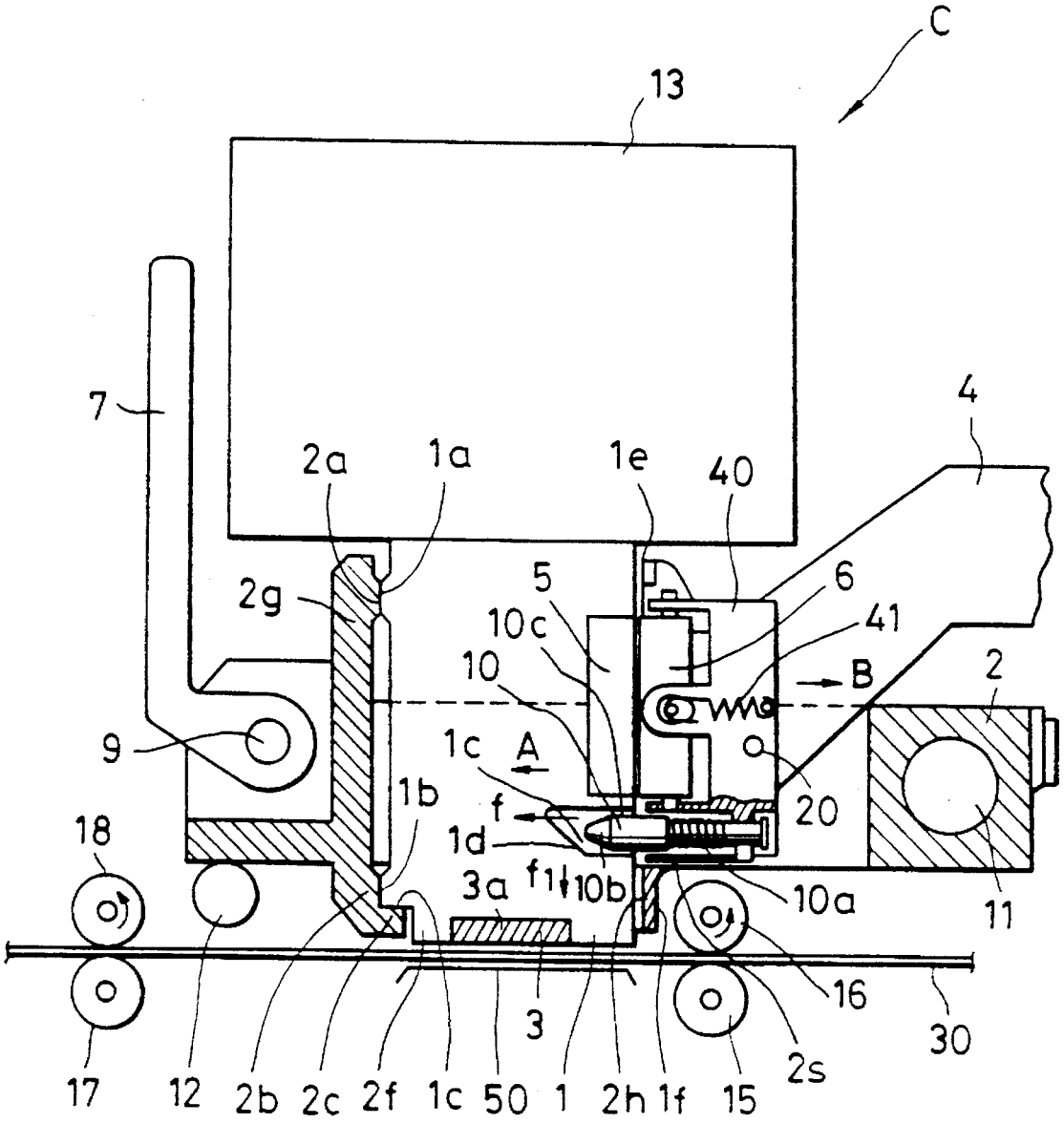
FIGS. 17A, 17B, 17C and 17D show a fourth embodiment of the liquid jet recording apparatus according to the present invention.
Figure 17B:
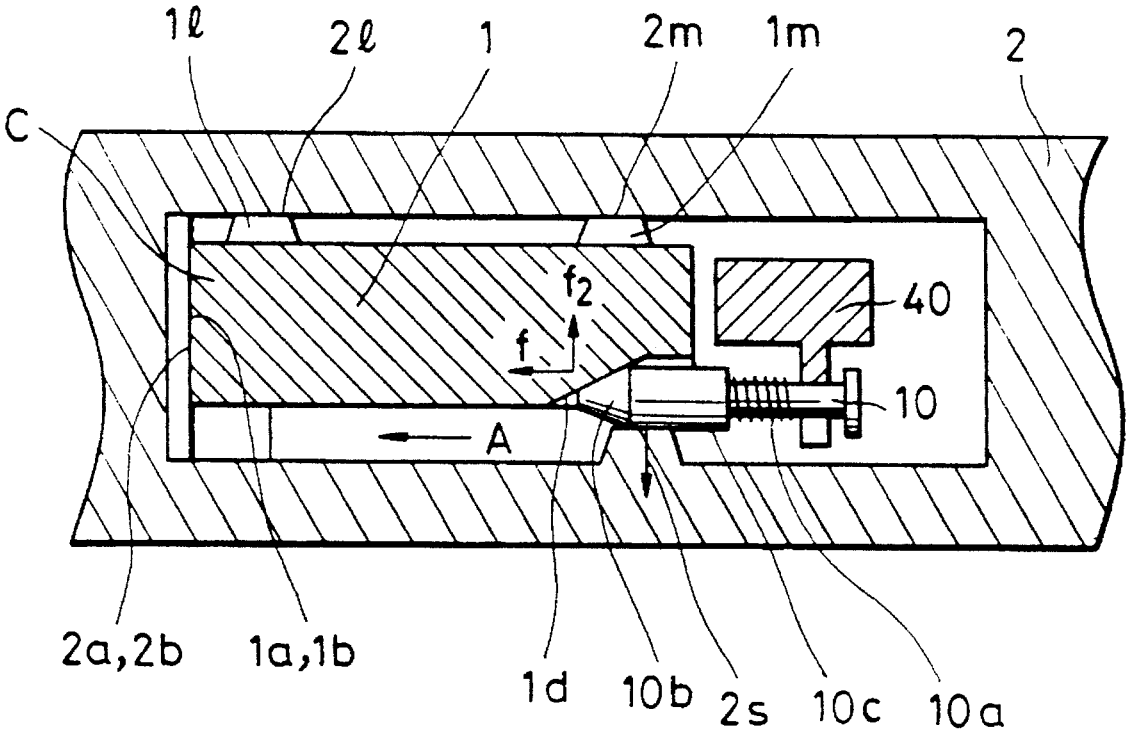

FIG. 17B shows a state in which the recording head is positioned in a direction of scanning. As shown in FIG. 17B, the recording head 1 has three protrusions 1*l* and 1*m* (one of them being not shown), which make contact with contact surfaces 2*l* and 2*m* on the carriage 2 so as to position the recording head in the direction of scanning. The presence of the inclined surface 1*d* of the recording head 1 generates a component f2 of the pressure f applied by the pressing pin 10, which presses the protrusions 1*l* and 1*m* against the contact surfaces 2*l* and 2*m* on the carriage 2 and thereby positions the recording head in the direction of scanning.

Figure 17C:
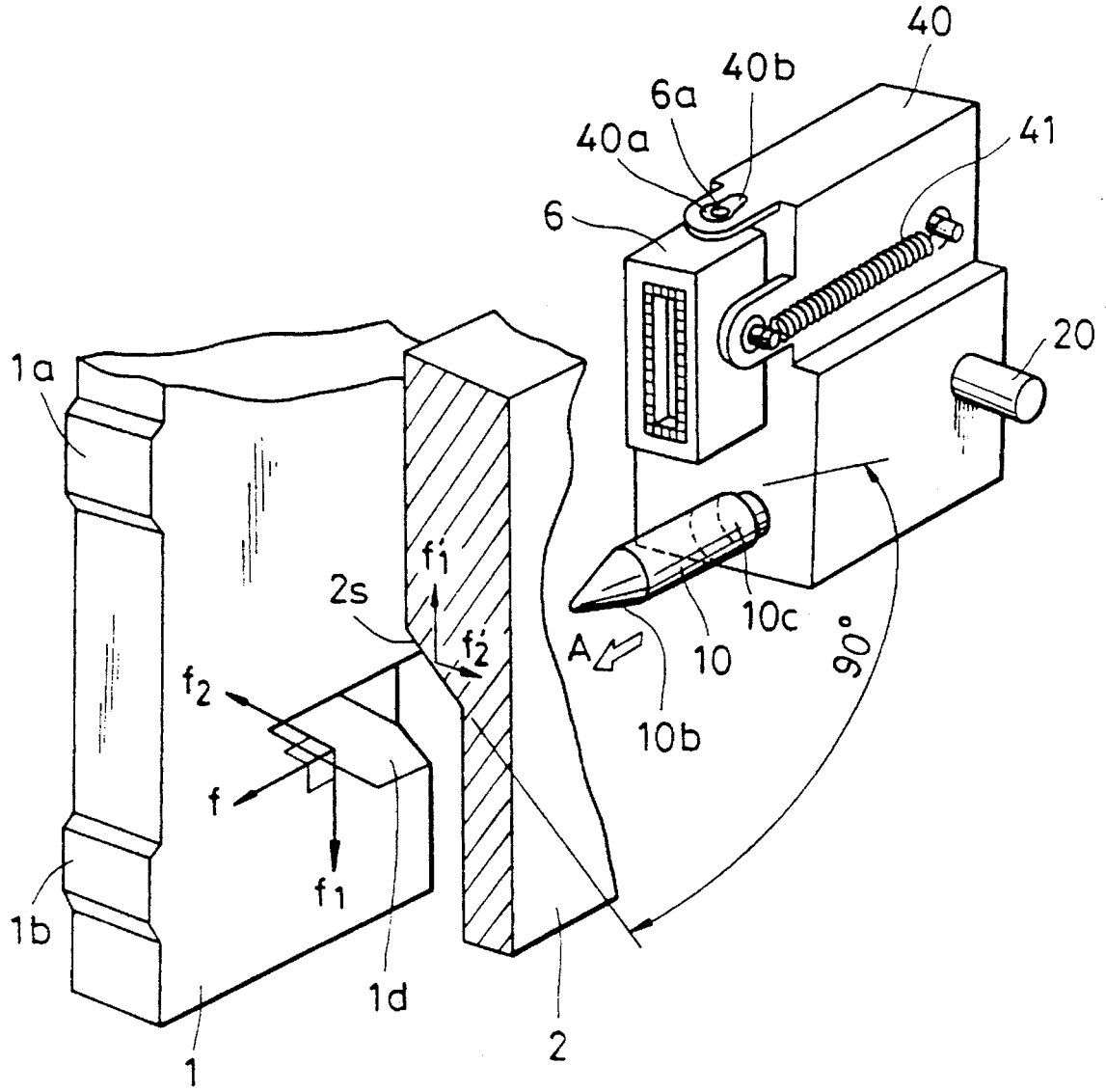
Figure 17D:
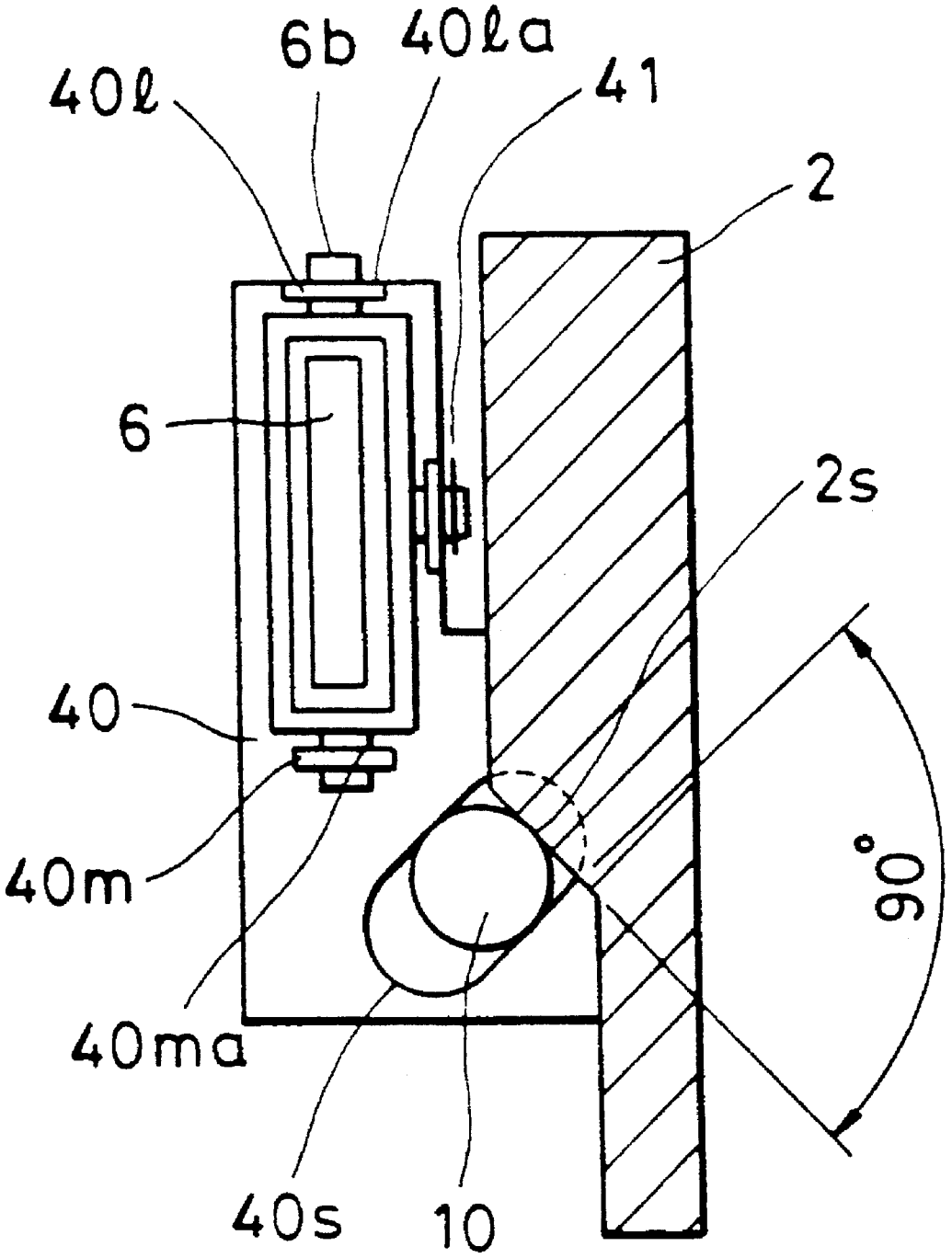

Thus, as the pressing pin 10 is moved in the direction indicated by the arrow A and the distal end 10*b* of the pressing pin 10 thereby abuts against the the inclined surface 1*d* of the recording head 1, generating the pushing force f, the components f1 and f2 of the pushing force f are generated by the presence of the inclined surface 1*d*, and the recording head 1 is pressed and positioned in both the vertical and horizontal directions. Furthermore, in the present embodiment, since the outer peripheral surface 10*c* of the pressing pin 10 is in contact with an inclined surface 2*s* of the carriage, reactions f1' and f2' of the components f1 and f2 are received by this inclined surface 2*s*, as shown in FIG. 17C. Moreover, an engagement slit 40*s* formed in the connector holder 40 into which the pressing pin 10 is inserted is elongated, and this elongated slit 40*s* and the inclined surface 2*s* form a right angle (90 degrees). In consequence, even if the pressing pin 10 is inserted between the inclined surface 1*d* of the recording head 1 and the inclined surface 2*s* of the carriage 2 in a slightly shifting state, neither the component f1 nor f2 is applied to the pin 10.

Thus, in the present invention, when the cartridge C is mounted on the mounting portion 2*f*, no moment is applied to the pressing pin 10 which is the pressurizing shaft, and this allows the pressing pin 10 to advance from the connector holder 40 smoothly and thereby ensures that the recording head 1 is positioned accurately by the elastic force of the spring 10*a*. As a result, only the pushing force f in an axial direction of the pressing pin 10 acts between the pressing pin 10 and the connector holder 40, thus eliminating scuffing of the pressing pin 10 and reducing the force required to move the connector holder 40.

Figure 18:
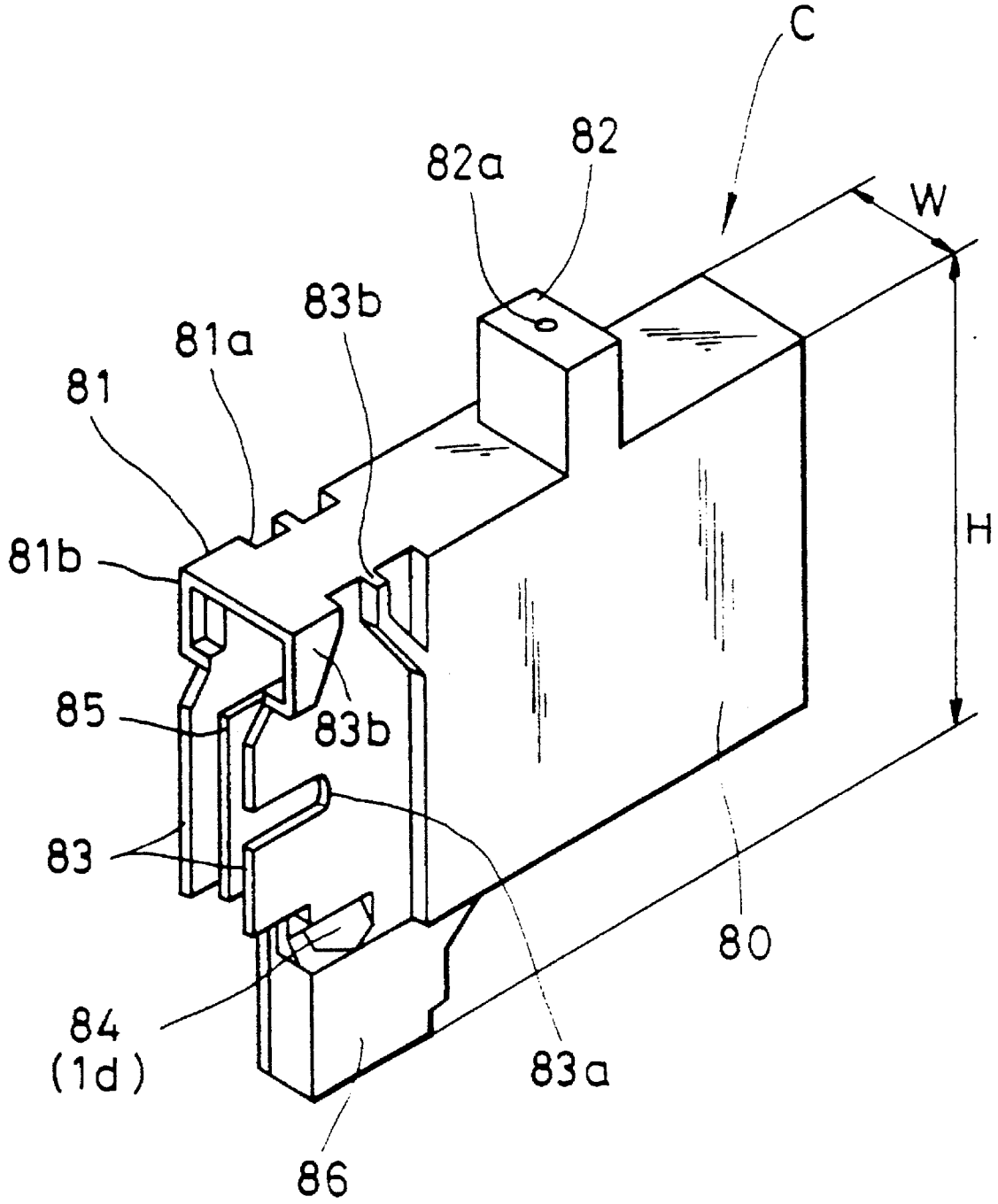
FIG. 18 is a perspective view of another example of the cartridge employed in the present invention.

FIG. 18 shows another example of the cartridge C.

In this example, the thickness W of the cartridge in the direction of scanning is small, and this allows a carriage which accommodates a plurality of cartridges in a aligned state to be made small.

The cartridge C has an ink tank portion 80 for containing ink. Connector covers 83 are formed integrally with the outer wall of the tank portion 80 so as to prevent careless contact of the connector 85. A positioning portion 81 consists of contact surfaces 81*a* and 81*b*. Provision of contact surfaces on the recording head 86 (having a plurality of nozzles whose discharge surfaces are directed downward) at positions which are separated from these contact surfaces 81*a* and 81*b* sufficiently allows the recording head to be fixed reliably when the inclined surface 84 is pressed by the pressing pin 10. A knob 82 is used when the cartridge C is mounted on and removed from the mounting portion. The knob 82 has an air vent 82*a*. A notch 83*a* and guides 83*b* are guides of the cartridge C which are used when the cartridge is mounted on the mounting portion.

Figure 19A:
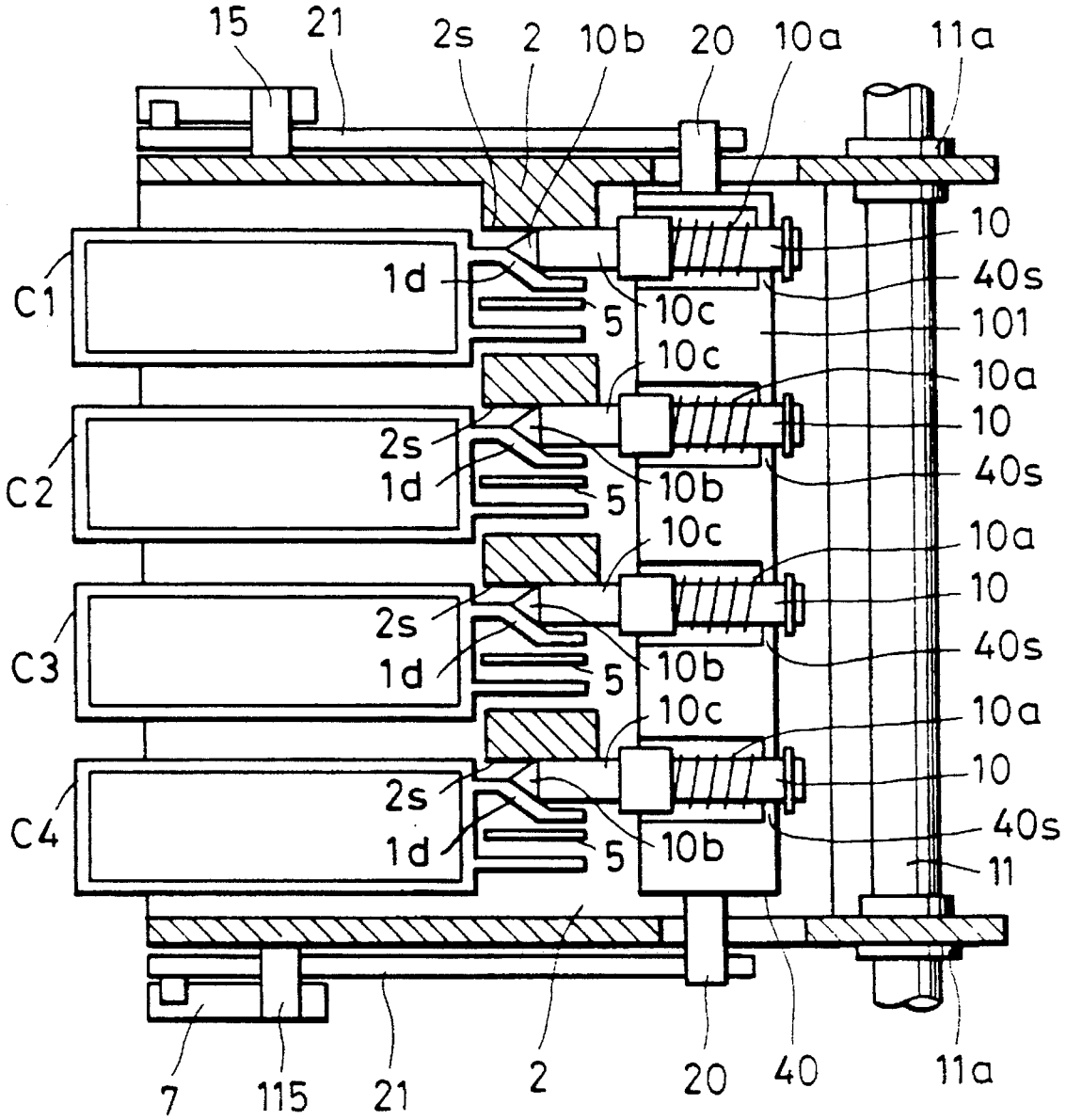
FIG. 19A is a plan view, partly in cross-section, of an example of a full-color liquid jet recording apparatus to which the present invention is applied.
Figure 19B:
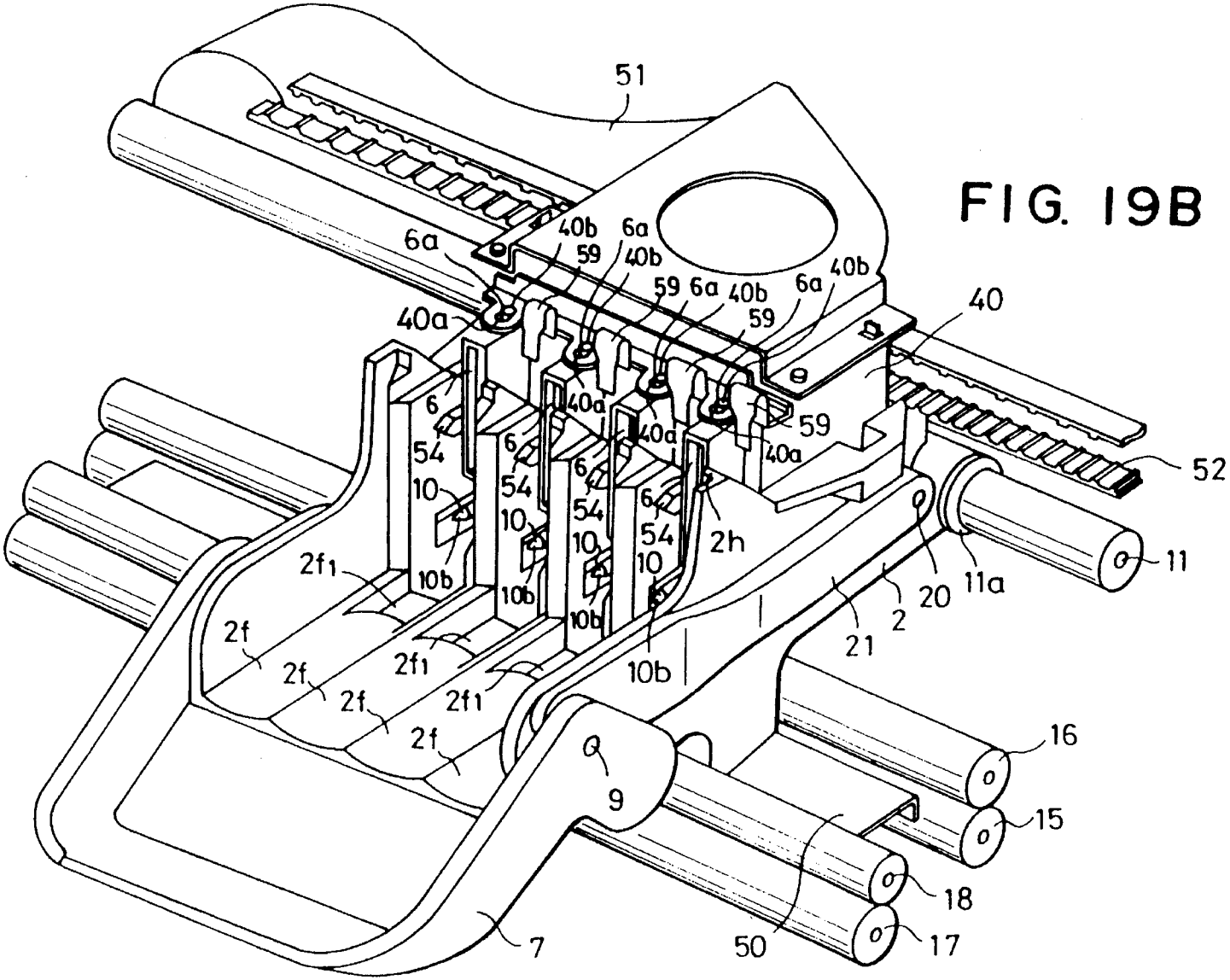
FIG. 19B is a schematic perspective view of the liquid jet recording apparatus of FIG. 19A.

FIGS. 19A and 19B show an example of a full color ink jet recording apparatus which employs a plurality of recording heads. It is assumed that the cartridge shown in FIG. 18 is employed in this recording apparatus. In FIGS. 19A and 19B, the same reference numerals are used to denote parts which are the same as those of the preceding embodiment.

In this example, four cartridges C1, C2, C2 and C4 (containing ink of different colors, e.g., yellow, magenta, cyan and black) of the type shown in FIG. 18 are positioned on the carriage 2.

The connector holder 40 has four pressing pins 10, which are urged in the leftward direction as viewed in FIGS. 19A and 19B by the corresponding springs 10*a*. The connector holder 40 engages with the links 21 through the shafts 20, and is movable in the rightward or leftward direction as the lever 7 engaged with the links 21 is rotated clockwise or counterclockwise. When the connector holder 40 is moved in the rightward direction, pressurization is removed and the cartridges become exchangeable. When the cartridges are mounted on the carriage, the connector holder 40 is moved in the leftward direction.

When the cartridges C are to be mounted on the mounting portions 2*f*, the recording heads 86 of the cartridges C are inserted into recesses 2f1 of the mounting portions 2*f* from above. At that time, rectangular portions 2*h* of the carriage 2 are fitted between the guides 83*b* of the cartridges C, by means of which the cartridges C are roughly positioned. Thereafter, the operation lever 7 is pivoted clockwise so as to advance the holder 40. As the holder 40 is moved forward, the guides 54 of the carriage 2 are inserted into the notches 83*a* of the cartridges C and the pins 10 are brought into engagement with the cartridges C, whereby the cartridges C are mounted on the mounting portions 2*f*. Springs 59 are provided on the carriage 2 for pressing the cartridges C mounted on the mounting portions 2*f* rearwardly and thereby positioning the cartridges with a high degree of accuracy. When the cartridges C have been mounted on the respective mounting portions 2*f*, the distal ends 10*b* of the pressing pins 10 are in contact with the contact surfaces 1*d* of the cartridges C (C1 to C4), pressing the cartridges. Also, the outer peripheral surfaces 10*c* of the pins 10 are in contact with the contact surfaces 2S of the carriage 2 which separately receive thrusts in directions perpendicular to the pressing pin. In consequence, the retaining member 40 receives only reactions of the springs 10*a*, no thrusts being applied to the retaining member 40. This enables the lever 7 to be operated with a small amount of force when a plurality of cartridges are simultaneously removed from the mounting portions. Reference numerals 11*a* denote bearings, 51 a flexible cable, and 52 a toothed belt through which a driving force for moving back and forth the carriage 2 is transmitted to the carriage 2.

Figure 20:
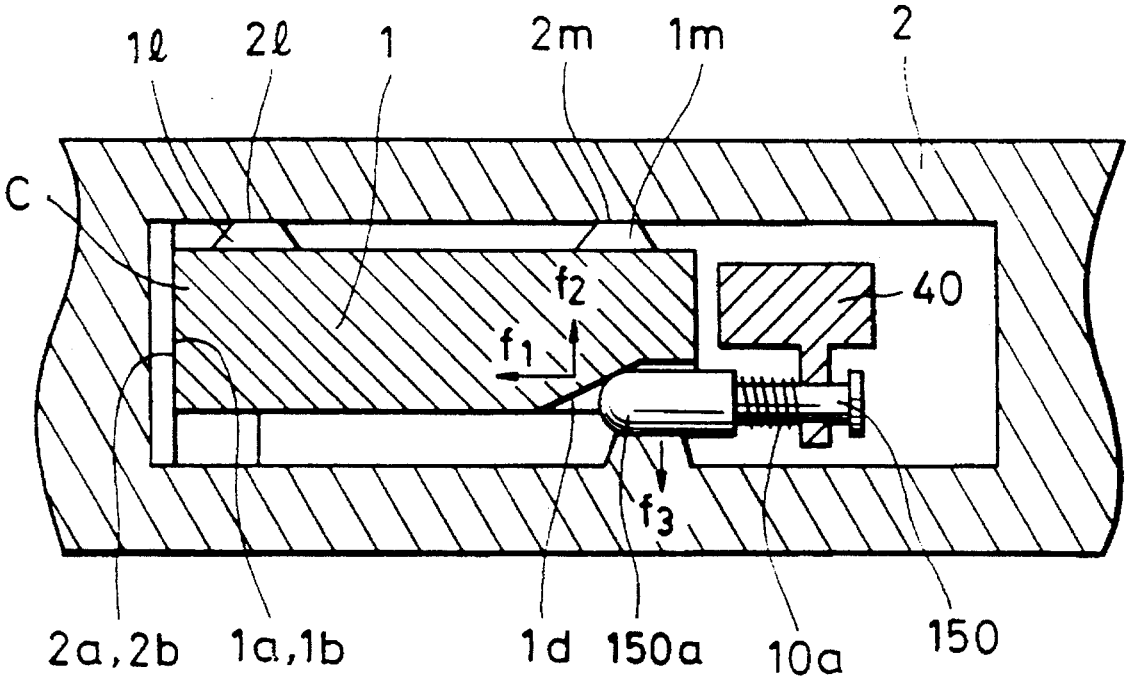
FIG. 20 is a plan view, partly in cross-section, of another example of the vicinity of a pushing shaft (pushing pin)

FIG. 20 shows another example of the pushing pin.

A pushing pin 150 of this example has a rounded distal end 150*a*, which makes contact with the inclined surface 2*d* of the recording head. Like the pushing pin shown in FIG. 17B, the pushing pin 150 having such a rounded distal end is capable of generating a pushing force f having a component f2 thereof in a direction perpendicular to the axial direction, which acts on the inclined surface 1*d* of the recording head, when the pushing pin 150 is pressed in its axial direction.

In this invention, the body connector may be connected to the cartridge connector by moving both connectors or either of them.

Figure 21:
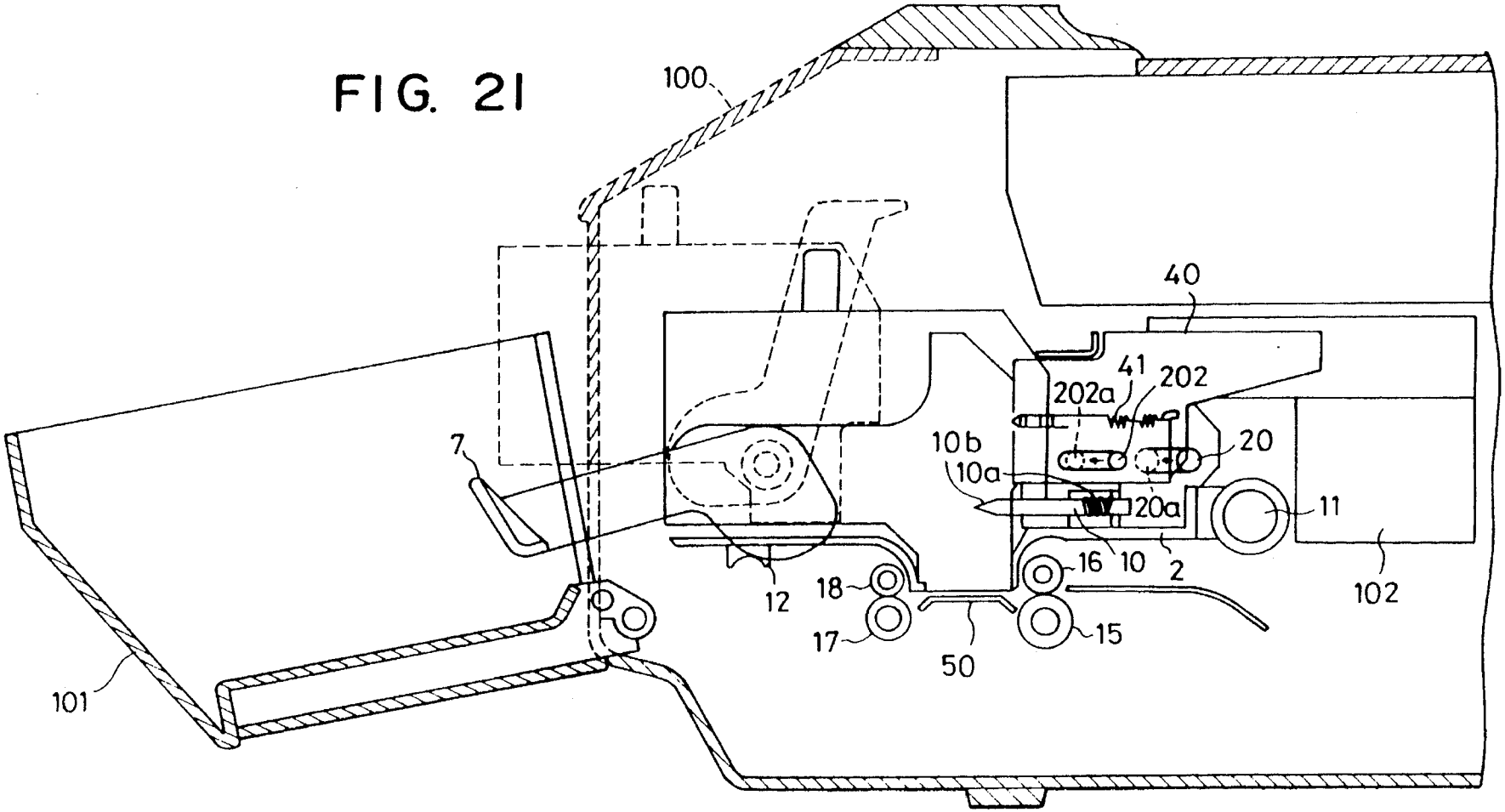
FIG. 21 is a schematic view of an example of a liquid jet recording apparatus body to which the present invention is applied.

FIG. 21 schematically shows a recording apparatus, such as a printer, a copier, or a facsimile, in which the present invention is carried out.

A recording apparatus body 100 has an openable cover 101 at an operation side thereof. When the cover 101 is pivoted about a central shaft thereof and is thereby opened, the interior of the apparatus body becomes exposed. This opening of the cover 101 permits pivotal operation of the lever 7 and, hence, mounting and removal of bubble-jet type recording head cartridges A, B, C and D on and from the apparatus body. When the lever 7 is pivoted to a position shown by the solid line in FIG. 21, the cartridges shown in FIG. 18 can be mounted on the carriage. Positioning of the lever 7 at that position precludes closing of the cover 101, so that the device is protected from accidental closing. The cartridge C shown by the broken line in FIG. 21 represents that which is being mounted on the apparatus, and the solid line in FIG. 21 represents the cartridge after it has been located at a predetermined position in the apparatus body for recording. When the cartridge is at its predetermined position in the apparatus, the recording head protrudes downwardly between recording medium conveying rollers 16 and 18, and the discharge openings of the recording head face the guide surface of a platen 50. A reference numeral 102 denotes a flexible sheet of an electric wiring portion, and reference numerals 11 and 12 designate carriage guiding rails.

The connector holder 40 is shown as in a state where the cartridge has been inserted and then fixed relative to the carriage by the pivot of the lever to a position shown by the broken line. For details, see FIGS. 17A, 17B, 17C, 17D, 18, 19A and 19B and the descriptions made with reference to these figures. Shafts 20 and 202 are provided on the two sides with respect to the direction in which the connector holder 40 is moved relative to the carriage. The shafts 20 and 202 are aligned at the same level. The shafts 20 and 202 are fitted into two slots elongated in a straight line with each other on the two side surfaces of the carriage in such a manner as to be slidable therealong. The shafts 20 and 202 located at the positions shown by the solid line correspond to the lever 7 shown by the solid line. The shafts 20 and 202 shown by the broken line correspond to the lever 7 shown by the broken line. The shafts 20 and 202 ensure more reliable parallel movement of the connector holder. In this embodiment, the shafts 20 and 202 are not provided on the connector body but are disposed above and in the vicinity of the recording head positioning pushing pin 10 so as to improve the accuracy with which the pushing pin is positioned. Alternatively, shafts similar to the shafts 20 and 202 may be provided on the connector body so as to ensure stable parallel movement of the connector body. In that case, it is preferable to arrange the body connector such that it becomes movable in the leftward and rightward directions by a distance equal to a gap after it has been connected to the cartridge connector. In this embodiment, the elongated slot for the shaft 202 may be formed such that the shaft 202 becomes movable in the rightward and leftward directions after the connection of the connectors so that the pushing pin 10 can be positioned only through the shaft 20.

Figure 22:
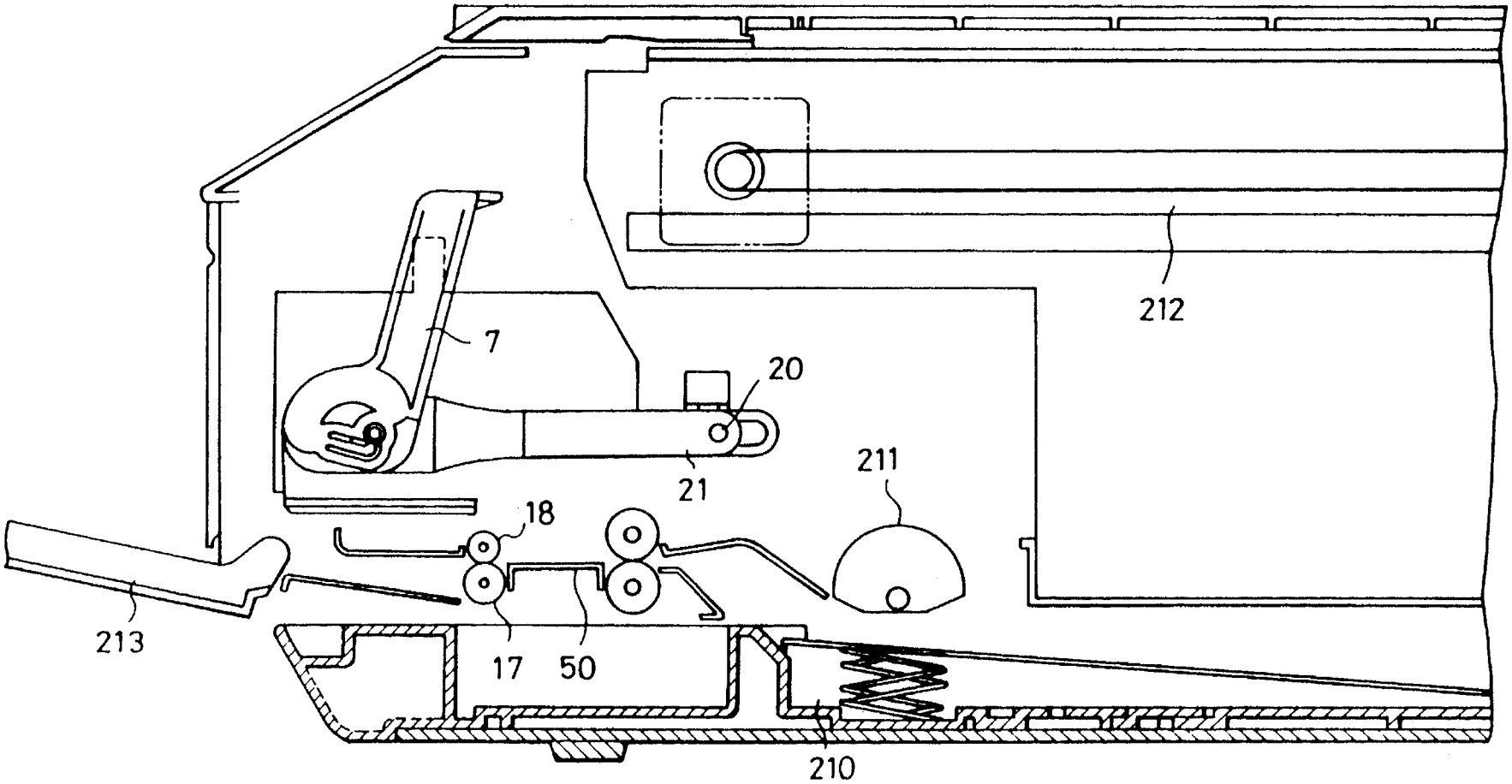
FIG. 22 is a schematic view of an example of the vicinity of a lever operation portion of the apparatus shown in FIG. 21.

FIG. 22 is a view similar to FIG. 19A, and shows the engagement of the lever 7 with the shaft 20. As has been described with reference to FIG. 19A, the link 21 connects the lever 7 with the shaft 20. The recording apparatus body of this embodiment is a copier, the configuration of which is described below in brief. Below an original pressing plate and an original glass table are disposed an optical reading means and a means for converting the information which is read by the optical reading means to produce an electrical signal. The obtained electrical signal is converted by the flexible sheet into a recording head driving signal, which is supplied to the recording head to form a full color ink image. A cassette 210 is inserted into the lower portion of the apparatus body from the side of a discharge tray 213. The recording medium is conveyed out of the cassette by a feeding roller 211 in the direction opposite to that of the insertion of the cassette.

The present invention is not limited to the aforementioned embodiments and various changes may be possible without departing from the scope of the invention.

As will be understood from the foregoing description, in the third and fourth embodiments, the connector for electrically connecting the recording head with the apparatus body is in a positioned state while it is inserted into the recording head. The connector is released from its positioned state after the insertion. In consequence, the recording head can be exchanged by a simple operation, and accurate positioning of the recording head and the reliable electrical connection are enabled. More specifically, according to the third and fourth embodiments, both the electrical connection between the recording head and the carriage and positioning of the recording head can be achieved by one operation. While the body connector is being inserted into the head connector, the body connector is in a positioned state. After the insertion, the body connector is released from its positioned state. This allows the recording head to be positioned only by the pushing of the pressing member, thus eliminating involvement of the connector in the positioning of the recording head.

Thus, the recording head can be mounted on and removed from the apparatus body by a series of operations, improving the mounting and removal operation.

In the aforementioned structures, positioning of the cartridge (the recording head) relative to the carriage is performed utilizing part of the frame of the cartridge with the recording head. The following embodiment is a modified form in which part of the member which constitutes the recording head is utilized for positioning.

[Embodiment 5]

Figure 23:
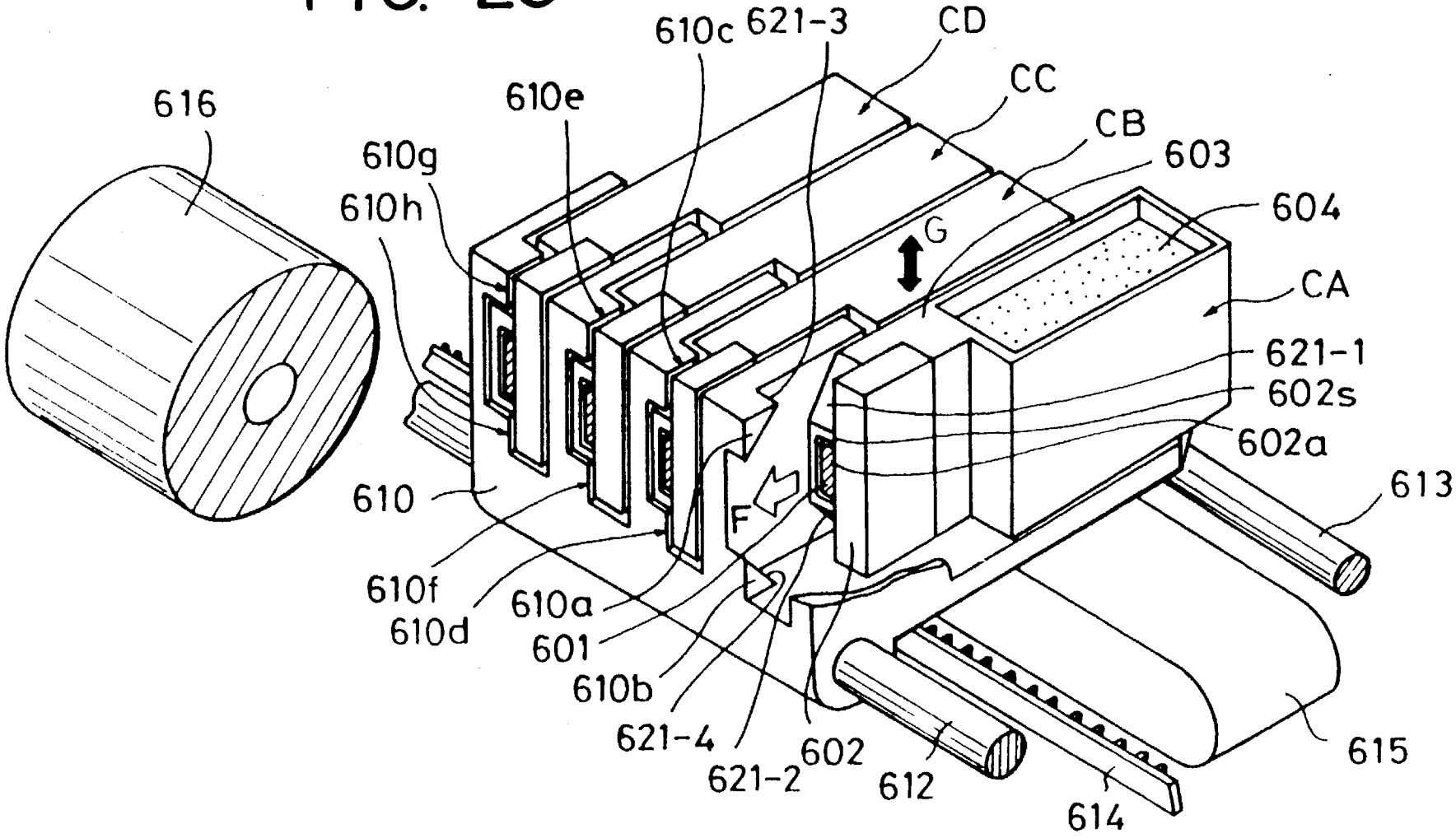
FIG. 23 is a schematic perspective view of certain parts of a liquid jet recording apparatus, showing a fifth embodiment of the present invention.

FIG. 23 is a perspective view of a carriage portion.

A reference numeral 601 denotes a heater board. A reference numeral 602 denotes a ceiling plate. The ceiling plate 602 has on its contact surface 602*s* grooves 602*a*, and the heater board 601 has on its contact surface heat generating elements (not shown) for generating heat required for discharge of droplets. The heat generating elements are located on the heater board 601 at positions corresponding to these grooves 602*a*. At least discharge openings and liquid passages communicating with the discharge openings are formed by the contact of the heater board 601 with the ceiling plate 602 in a predetermined positional relationship.

The wall or the grooves may be formed on the ceiling plate or on both the substrate and the ceiling plate. Alternatively, the liquid passages may be formed by contacting the flat plate-like substrate with the ceiling plate with another member constituting the wall of the liquid passage interposed therebetween.

The discharge openings may be formed by the contact of the substrate with the ceiling plate. Alternatively, the discharge openings may be formed by forming holes at positions of the plate-like member which correspond to the liquid passages and causing the liquid passages to communicate with the openings.

A recording head is comprised of the ceiling plate 602 and a supporting frame 603 to which the ceiling plate 602 is attached. The supporting frame 603 accommodates an absorbing material 604 impregnated with a recording liquid (ink). The ink absorbing material is capable of supplying ink to the discharge openings while precluding flow and stir of the ink during the scanning.

The ceiling plate 602 of the recording head is formed in a larger size than that of the heater board 601. The two end portions of the contact surface 602*s* of the ceiling plate 602 extend externally to form extended exposed surfaces.

When a recording head CA is inserted into a carriage 610, contact surfaces 610*a* and 610*b* of the carriage 610 make contact with the extended exposed surfaces of the ceiling plate of the recording head CA, by means of which the recording head is positioned at least in a direction perpendicular to the contact surfaces, i.e., the recording head is positioned with a high degree of accuracy in a direction in which the carriage is moved for scanning.

Furthermore, the recording head CA and the carriage 610 have surfaces 621-1, 621-2, 621-3 and 621-4 which make contact with each other, whereby the recording head is positioned in the same direction of the contact surface of the recording head.

The surface 621-1 of the recording head CA makes contact with the surface 621-3 of the carriage 610, and the surface 621-2 of the recording head CA contacts the surface 621-4 of the carriage 610.

The surfaces 621-1 and 621-2 of the recording head CA and the surfaces 621-3 and 621-4 of the carriage 610 are inclined at a predetermined angle in such a manner that they are opened toward the direction in which the recording head is inserted into the carriage.

When the recording head CA is inserted into the carriage 610, these surfaces make contact with the corresponding surfaces, by means of which the recording head CA is positioned in the same direction as that in which droplets are discharged, i.e., in the forward direction (in the same direction as that in which the discharge openings are opened, which is indicated by the arrow F), as well as in the direction perpendicular to the direction in which the carriage is moved for scanning, i.e., in the upward and downward direction (in the direction in which the discharge openings are aligned, which is indicated by the arrow G).

Other recording heads CB, CC and CD have the same configurations, and the carriage 610 has other contact surfaces 610*c*, 610*d*, 610*e*, 610*f*, 610*g* and 610*h*, which make contact with these recording heads CB, CC and CD.

The carriage 610 slides along a scanning rail 612 and an impulse rail 613 during scanning.

A reference numeral 614 denotes a driving belt for driving the carriage 610, 615 a flexible cable through which an image signal is sent to the individual recording heads, and 616 a platen roller for conveying the recording paper which is a recording medium.

Figure 24:
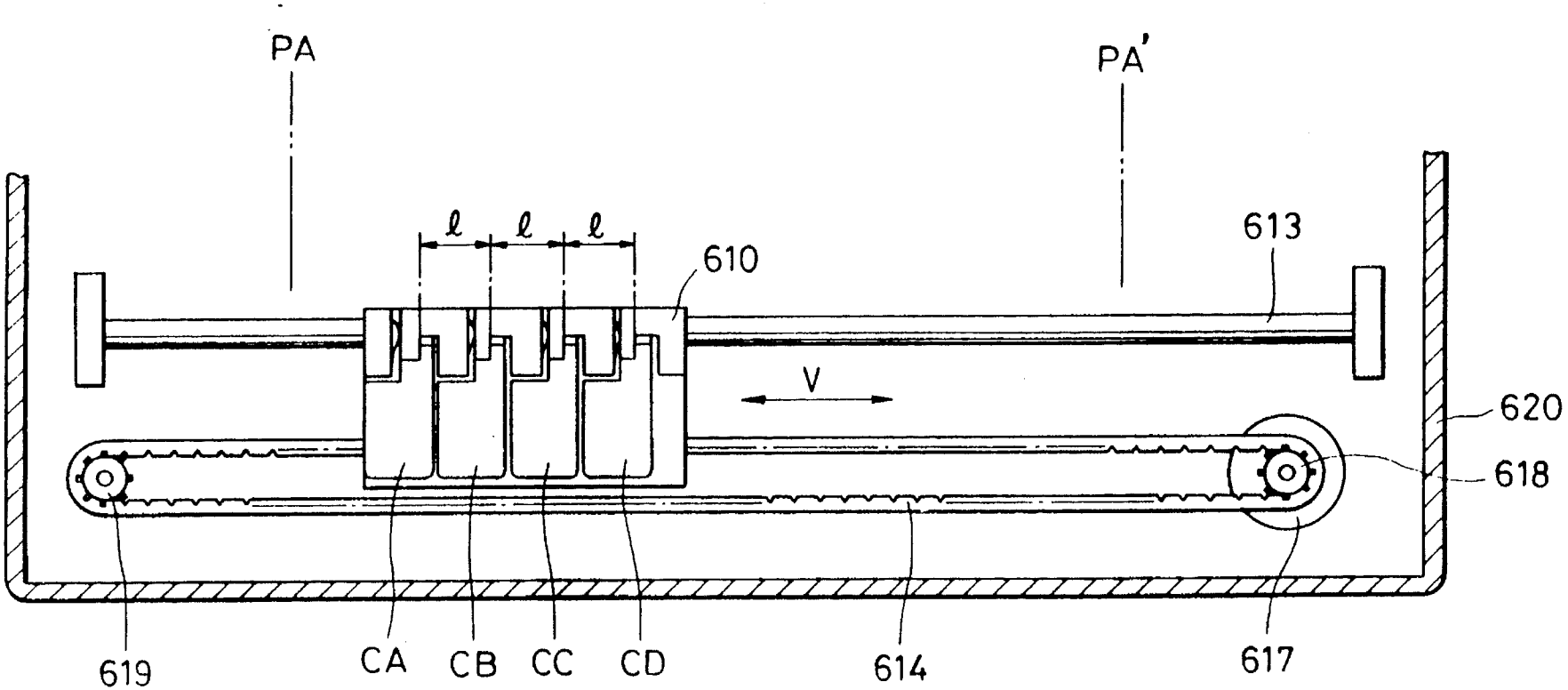
FIG. 24 is a plan view of certain parts of the apparatus of FIG. 23.

FIG. 24 is a view of the recording apparatus incorporating the structure shown in FIG. 23.

The driving belt 614 wound around pulleys 618 and 619 is driven by a driving motor 617, whereby the carriage 610 is moved for scanning.

The recording paper is fed in the upward direction as viewed in FIG. 24 in a range defined by PA and PA'. During the scanning, the carriage 610 is moved in the direction indicated by the arrows V at a fixed speed, during which time ink droplets are discharged from the recording heads CA, CB, CC and CD in sequence at predetermined intervals so as to form an image.

At that time, ink droplets discharged from, for example, the recording heads CA, CB, CC and CD may be laid on top of the other on a predetermined point on the recording paper in accordance with the recording information. At that time, since the discharge opening arrays of the individual recording heads are disposed with a high degree of accuracy at a fixed interval l defined by the adjacent contact surfaces of the carriage 610, an image having a high quality can be obtained.

In this embodiment, the recording heads are positioned relative to the carriage using the surfaces thereof on which discharge openings are formed. In consequence, variations in the thickness of or warpage of the supporting plates or the substrates of the recording head do not affect the accuracy with which the discharge opening arrays are disposed relative to the carriage, and accurate disposal of the discharge opening arrays of the individual recording heads relative to the carriage is enabled.

When the recording heads are replaced with new ones, it is not necessary for the difference in the thickness between the supporting plates of the new recording heads and those of the old recording heads to be taken into consideration. Thus, this embodiment is particularly suitable for use in a recording apparatus which employs disposable recording heads.

Figure 25:
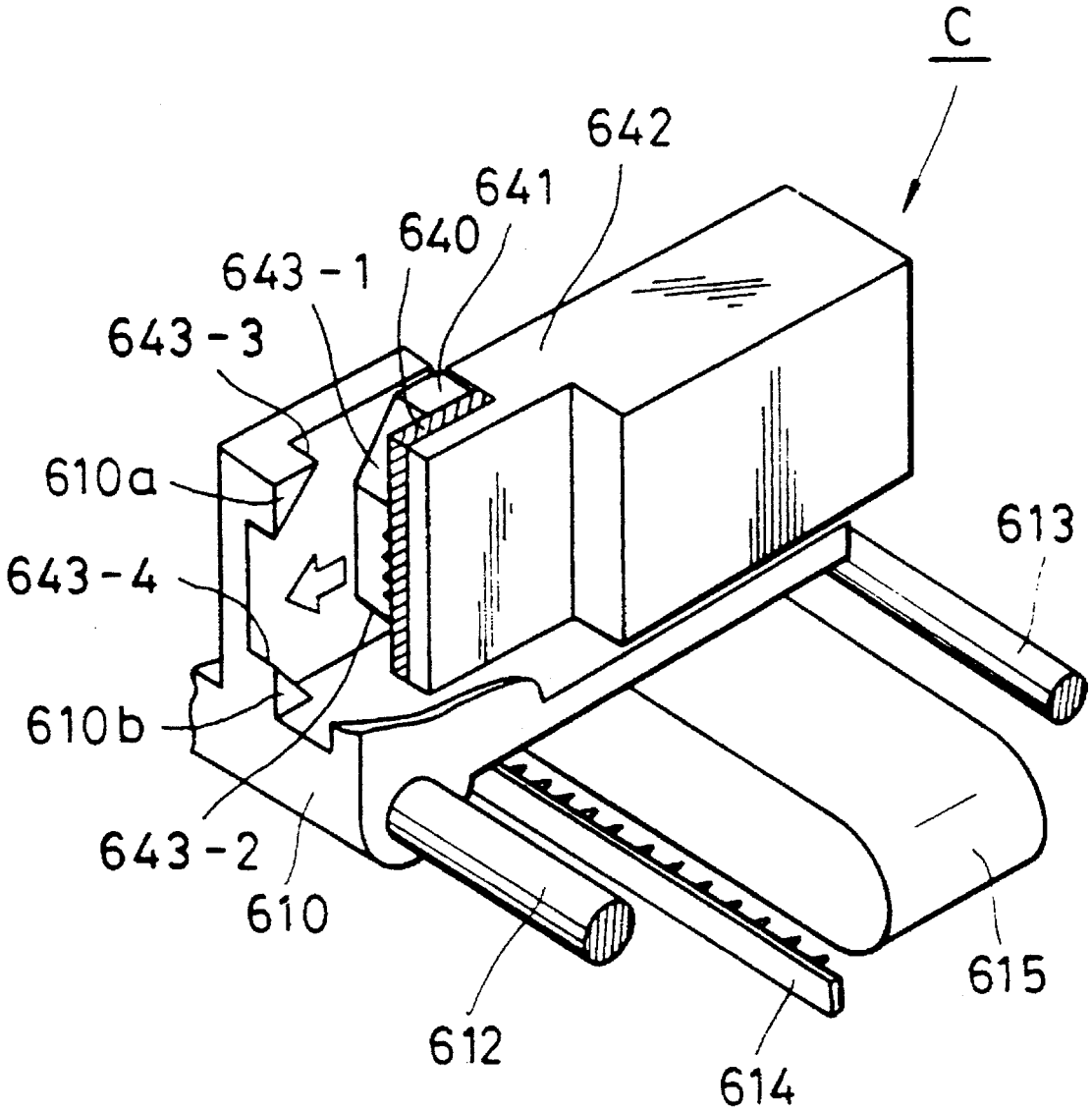
FIGS. 25 and 26 are schematic perspective views of other examples of the liquid jet recording apparatus of FIG. 23.

FIG. 25 shows another example of the recording apparatus.

In this example, the contact surface of a heater board 640 with which a ceiling plate 641 is in contact has protruding portions (reference surfaces for positioning). These reference surfaces make contact with the contact surfaces 610*a* and 610*b* of the carriage 610 when the recording head is positioned in the carriage.

Figure 26:
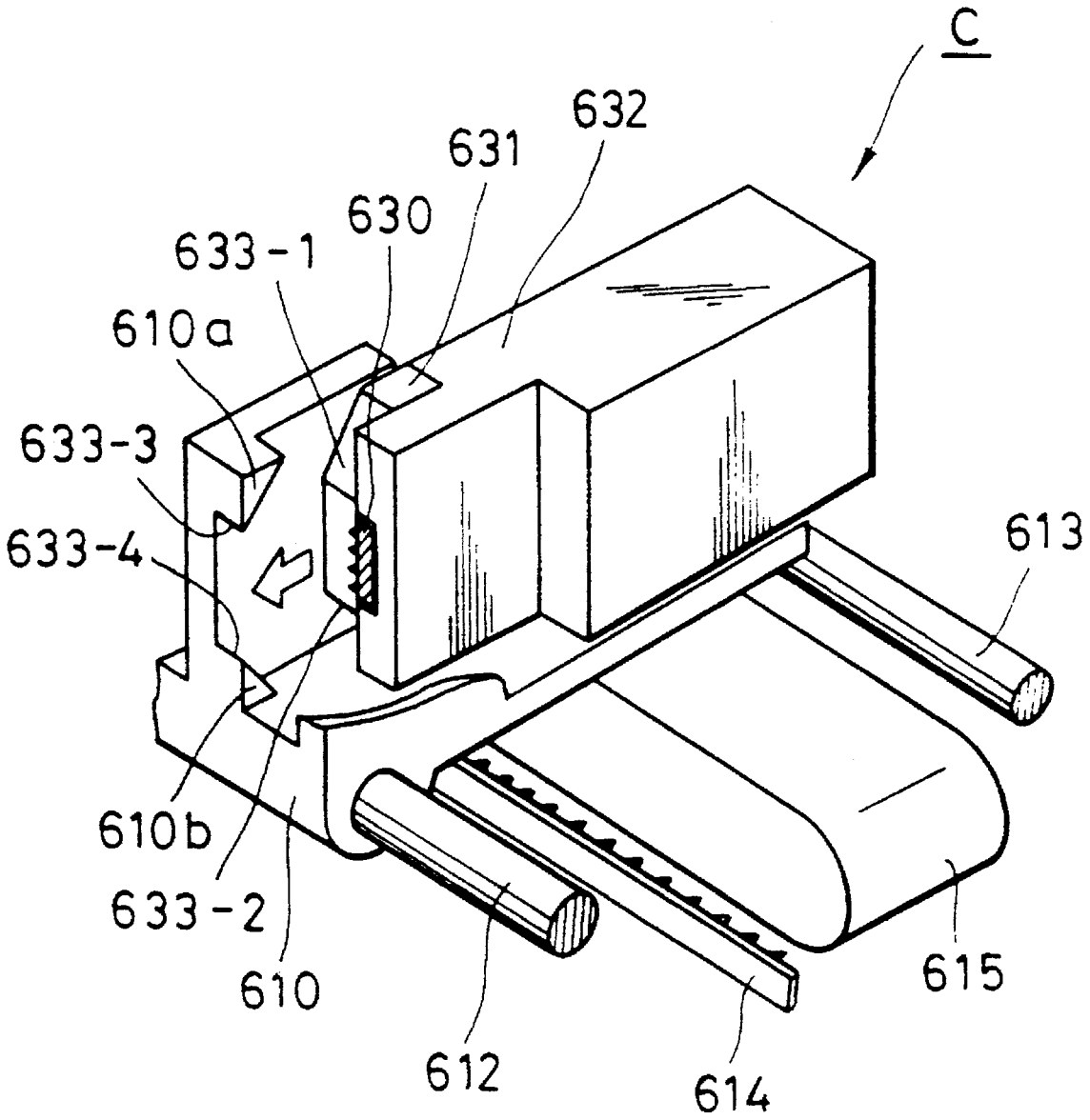

FIG. 26 shows another example of the recording apparatus. In this example, the contact surface of a supporting frame 632 with which it is in contact with a ceiling plate 631

(which is in the same plane as that on which the contact surface between the ceiling plate 631 and the heater board 630 is disposed) constitutes reference surfaces for positioning.

More specifically, the ceiling plate 631 is formed larger than the heater board 630, so that the two end portions of the surface thereof which is in contact with the heater board 630 are in contact with the supporting frame 632. Part of the surface of the supporting frame 632 which is in contact with the ceiling plate 631 extends externally so as to form the reference surfaces, which make contact with the contact surfaces 610*a* and 610*b* of the carriage 610 when the recording head is positioned in the carriage.

Thus, the recording head is positioned utilizing the contact surface between the supporting frame 632 and the ceiling plate 631, which is is the same plane as that between the heater board 630 and the ceiling plate 631. This ensures that the discharge opening arrays of the individual recording heads are disposed with a high degree of accuracy.

In the above-described examples, a recording apparatus which adopts the thermal pulse ink discharge method is employed. However, the present invention can be applied to any recording apparatus with a recording head in which at least a discharge opening array is formed on the contact surface between a plurality of members having a flat surface.

Furthermore, the present invention can also be applied to a recording apparatus which performs a full-color printing or a single color printing or which employs a plurality of recording heads so as to form on the recording material an ink dot having a large diameter.

In the fifth embodiment according to the present invention, when a plurality of recording heads are to be mounted on the carriage in a predetermined disposed state, the individual recording heads are positioned utilizing the reference surfaces which are in the same plane as the surface on which the discharge opening arrays of the recording heads are formed (the contact surface between a plurality of members).

In consequence, disposal of the discharge opening arrays of the individual recording heads relative to the carriage is directly determined by the positional relation between the recording heads and the carriage, and is not affected by variations in the thickness of or warpage of the supporting plates, the substrates or the ceiling plates, or by the floating of the contacting portions.

As a result, the discharge opening arrays of the plurality of recording heads can be disposed relative to the carriage with a high degree of accuracy even when there are variations in the supporting plate, the substrates or the ceiling plates of the recording heads.

Thus, in the recording apparatus according to the present invention, liquid droplets can be attached to the recording material at accurate positions, and this enables an image having a high quality to be obtained.

Furthermore, even if the precision or the strength of the components of the recording head decreases, as long as the positional relation (flatness) between the discharge opening array and the reference surfaces is maintained, the accuracy with which the discharge opening array is disposed relative to the carriage is not adversely affected at all, and an image having a high quality can be formed. As a result, resin products can be employed as the components of the recording head, which are conventionally difficult due to their inaccuracy, thus increasing mass productivity of the recording heads.

The present invention is particularly suitable for use in ink jet recording heads or ink jet recording apparatuses which adopt the bubble jet method.

Such ink jet recording heads or ink jet recording apparatuses are described in the specifications of, for example, U.S. Pat. Nos. 4,723,129, 4,740,796. These apparatus employ the basic principle of the ink jet recording method, and the present invention is therefore preferably applied thereto. Although this bubble jet method can be applied to both on-demand type and continuous type, it is preferable for it to be applied to the on-demand type, because, 1) in the on-demand type recording head, at least one driving signal is applied in response to the information to be recorded to each of the electrothermal energy conversion elements which are disposed in such a manner as to face the sheet in which the liquid (ink) is held and the liquid passage so as to generate thermal energy in the corresponding electrothermal energy conversion element and thereby causing film boiling to occur on the surface of the recording head, and because, 2) a bubble may therefore be formed in the liquid (ink) for each driving signal applied. The liquid (ink) is discharged from the outlet as the bubble grows and contracts to form at least one droplet. When the driving signal has a pulse-like form, growth and contraction of a bubble may be adequately performed, and liquid (ink) can therefore be discharged with excellent response. Driving of the recording head by means of a pulse-like signal has been proposed in the specification of, for example, U.S. Pat. Nos. 4,463,359 and 4,345,262. If the condition regarding the increase in the temperature of the heat acting surface of the recording head, which is described in the specification of U.S. Pat. No. 4,313,124, is adopted, more excellent recording is possible.

The recording head according to the present invention may be of the type in which the outlets, the liquid passages and the electrothermal energy conversion elements are provided in one-to-one correspondence (linear or bending liquid passages), like those disclosed in the aforementioned specifications, of the type in which the heat acting surface is disposed in a bending area, like those disclosed in the specifications of U.S. Pat. Nos. 4,558,333 and 4,459,600, of the type in which a slit is formed as the common outlet for a plurality of electrothermal energy conversion elements, like that disclosed in the specification of Japanese Patent Laid-Open No. 123670/1984, or of the type in which an opening for absorbing the pressure wave of the thermal energy is formed for each outlet, like that disclosed in the specification of Japanese Patent Laid-Open No. 138461/1984.

In the case of a full-line type recording head having a length corresponding to the maximum width of the recording medium on which the recording apparatus can perform recording, the recording head may consist of a plurality of recording heads or a single recording head. The present invention can be applied to either case.

The recording head according to the present invention may also be a chip type which is exchangeable, which can be electrically connected to the body and to which an ink can be supplied from the body when it is mounted on the body, or a cartridge type which is formed as one recording head.

Preferably, the ink jet recording apparatus according to the present invention incorporates various recording head restoring means and various auxiliary means for the purpose of providing stable recording. Such means include a capping means, a cleaning means and pressurizing or suction means for the recording head, a preliminary heating means which employs the electrothermal energy conversion elements, other heating elements or combinations of electrothermal energy conversion elements and other heating elements, and a preliminary discharge means for performing discharge other than that conducted for recording an image.

Furthermore, the ink jet recording apparatus according to the present invention may be one in which an image is recorded in one main color which may be black, or one in which an image can be recorded in a plurality of different colors or in a full color. Color recording may be achieved by employing a recording head which contains a plurality of colors or a plurality of recording heads which contain respective colors.

What is claimed is:

1. An ink jet apparatus comprising:

a head mounting portion for mounting an ink jet head thereon, said ink jet head having an electrically connecting portion;

an electrical connector disposed on a body side which is provided on a part of said head mounting portion, said electrical connector being dimensioned and disposed so as to allow electrical connection with said electrically connecting portion of said ink jet head; and an operation member for affixing said ink jet head to said head mounting portion and effecting the electrical connection;

characterized in that said electrical connector on the body side is supported by a supporting member; and, said electrical connector on the body side being released from said supporting member while the electrical connection between said electrical connector on the body side and said electrically connecting portion on the ink jet head is maintained through the affixation of said ink jet head to said head mounting portion, and the electrical connection between said electrically connecting portion on the ink jet head and said electrical connector on the body side is effected by operation of said operation member.

2. An ink jet recording apparatus according to claim 1, wherein said recording head portion utilizes heat energy for discharging ink, said recording head portion having an electrothermal conversion element for generating bubbles in the ink to eject ink droplets.

3. An ink jet recording apparatus according to claim 1, wherein said ink jet cartridge contains ink therein.

4. A method of mounting an ink jet cartridge on an ink jet apparatus, comprising the steps of:

positioning said ink jet cartridge relative to a mounting portion therefor on said ink jet apparatus;

supporting a body connector associated with said mounting portion on said ink jet apparatus with a supporting member;

connecting said body connector with a cartridge connector on said ink jet cartridge by bringing said cartridge connector and said body connector together to establish electrical contact;

releasing said body connector from said supporting member once said body connector and said cartridge connector are brought together, and electrical contact established therebetween; and allowing said body connector to move with said cartridge connector while maintaining electrical connection therebetween.

* * * * *